US007808517B2

(12) United States Patent
Sambongi et al.

(10) Patent No.: US 7,808,517 B2
(45) Date of Patent: Oct. 5, 2010

(54) THERMAL ACTIVATOR FOR HEAT SENSITIVE ADHESIVE SHEET AND PRINTER APPARATUS UTILIZING THE THERMAL ACTIVATOR

(75) Inventors: Norimitsu Sambongi, Chiba (JP); Minoru Hoshino, Chiba (JP); Shinichi Yoshida, Chiba (JP); Yoshinori Sato, Chiba (JP); Masanori Takahashi, Chiba (JP); Akihiko Ito, Chiba (JP)

(73) Assignee: Seiko Instruments Inc. (JP)

( * ) Notice: Subject to any disclaimer, the term of this patent is extended or adjusted under 35 U.S.C. 154(b) by 582 days.

(21) Appl. No.: 11/823,902

(22) Filed: Jun. 29, 2007

(65) Prior Publication Data

US 2007/0252886 A1 Nov. 1, 2007

Related U.S. Application Data

(62) Division of application No. 10/397,865, filed on Mar. 26, 2003, now abandoned.

(30) Foreign Application Priority Data

Apr. 19, 2002 (JP) ..... 2002-117925
Aug. 27, 2002 (JP) ..... 2002-247381

(51) Int. Cl.
*B41J 2/32* (2006.01)

(52) U.S. Cl. ..... 347/171

(58) Field of Classification Search ..... 347/171, 347/197, 218, 220–223; 400/120.01, 120.18, 400/578; 15/256.51, 256.53; 101/483, 423–425, 101/366, 363, 211, 147–148
See application file for complete search history.

(56) References Cited

U.S. PATENT DOCUMENTS 3,940,238 A * 2/1976 Bar-on ..... 432/75
3,986,227 A * 10/1976 Fathergill et al. ..... 15/256.53
5,614,928 A 3/1997 Matsuda ..... 347/2
6,031,553 A 2/2000 Nagamoto et al. ..... 347/171
6,172,698 B1 * 1/2001 Iwata et al. ..... 347/171

* cited by examiner

*Primary Examiner*—K. Feggins
(74) *Attorney, Agent, or Firm*—Adams & Wilks

(57) ABSTRACT

A thermal activator has a heating device that heats a heat sensitive adhesive layer of a heat sensitive adhesive sheet to activate the adhesive layer. The adhesive sheet has a printable surface formed on one side of a sheet-like base and the heat sensitive adhesive layer formed on the other side thereof. A transporting device transports the heat sensitive adhesive sheet in a predetermined direction. A sheet material prevents a heat sensitive adhesive of the heat sensitive adhesive layer or a denatured product of the heat sensitive adhesive from adhering to the transporting device.

18 Claims, 13 Drawing Sheets

FIG. 3A
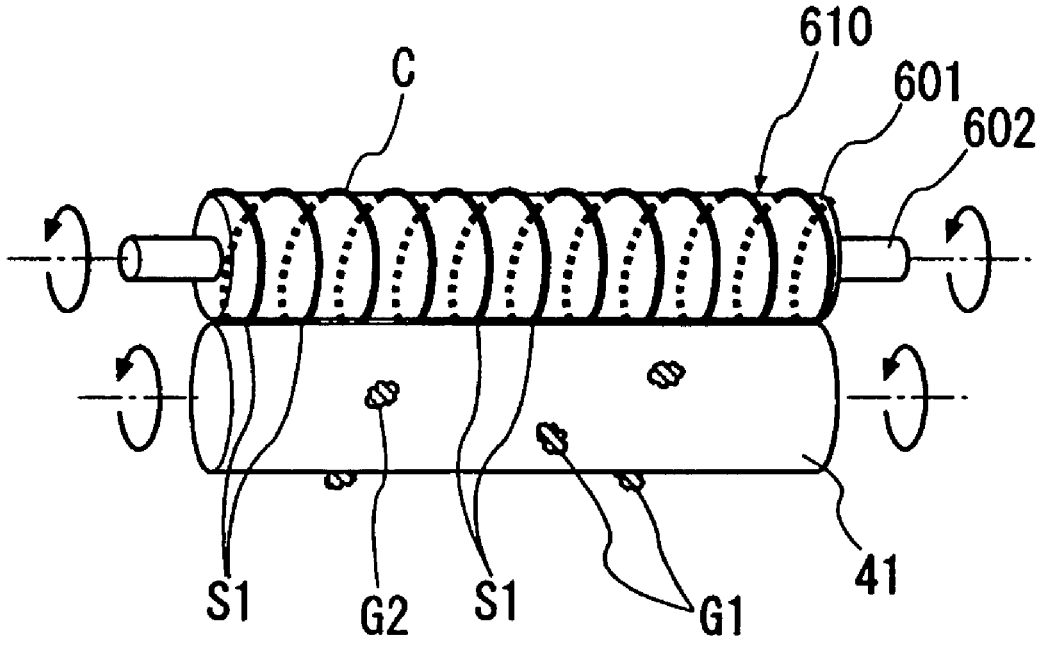
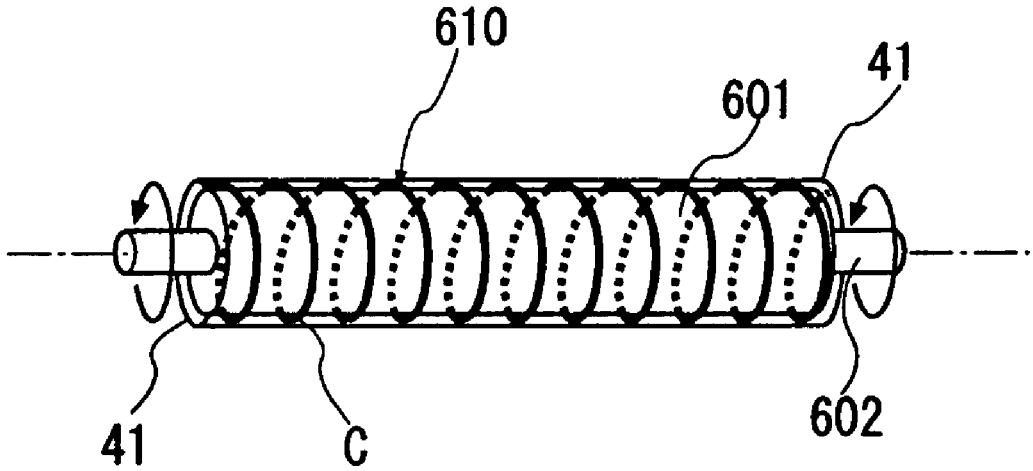
FIG. 3B

FIG. 4A
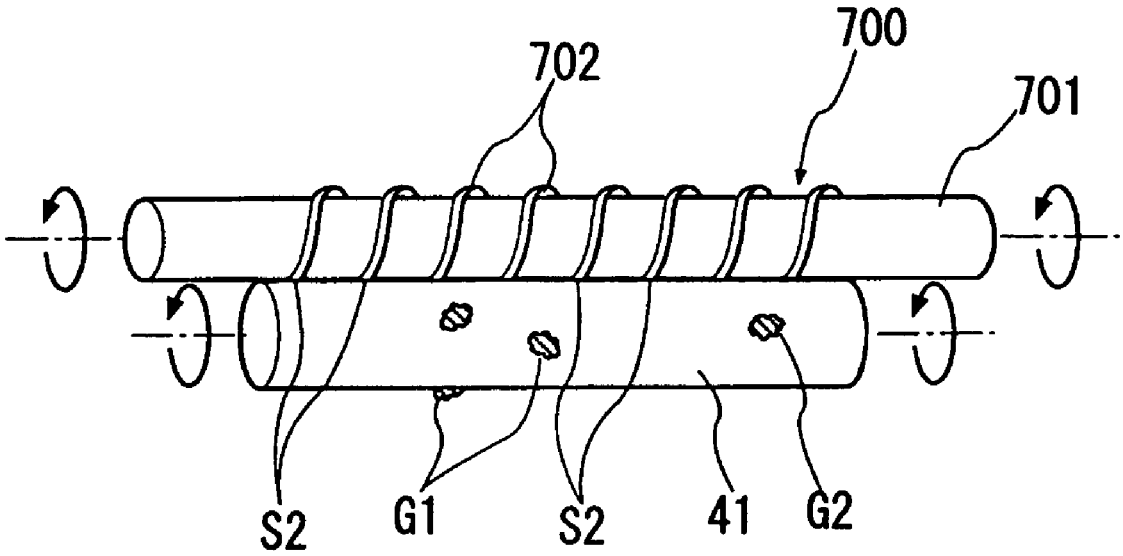
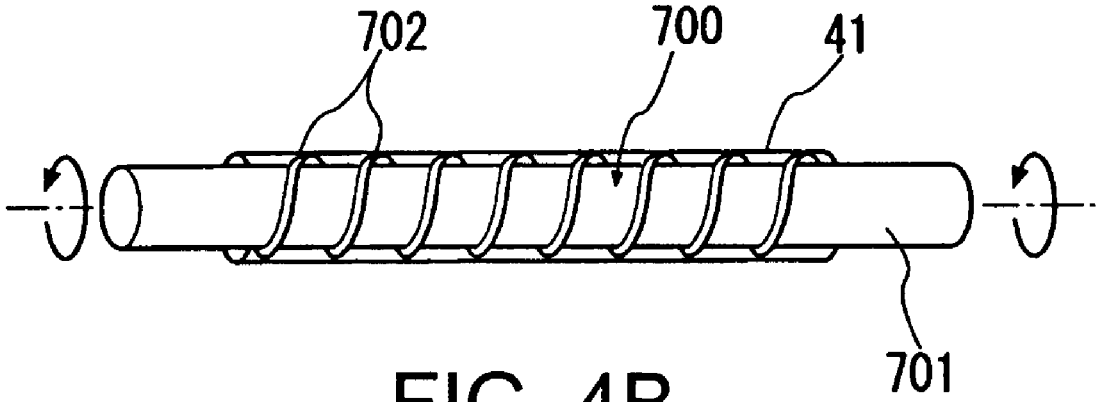
FIG. 4B

THERMAL ACTIVATOR FOR HEAT SENSITIVE ADHESIVE SHEET AND PRINTER APPARATUS UTILIZING THE THERMAL ACTIVATOR

CROSS-REFERENCE TO RELATED APPLICATIONS

This application is a divisional application of U.S. patent application Ser. No. 10/397,865 filed Mar. 26, 2003 now abandoned and claiming a priority date of Apr. 19, 2002.

BACKGROUND OF THE INVENTION

1. Field of the Invention

The present invention relates to a thermal activator for a heat sensitive adhesive sheet comprised of a sheet-like base material formed with a heat sensitive adhesive layer normally exhibiting a non-adhesive property and exhibiting an adhesive property when heated on one side thereof, and to a printer apparatus utilizing the thermal activator and, more particularly, to a technique that makes it possible to prevent a heat sensitive adhesive or a denatured product of the heat sensitive adhesive from adhering to transport means or to remove the same.

2. Description of the Related Art

Recently, heat sensitive adhesive sheets (heat sensitive adhesive labels) as one type of so-called linerless labels are used in various fields, e.g., for applying POS labels for foods, labels for physical distribution and delivery, labels for medical use, baggage tags, and indication labels for bottles and cans.

Such a heat sensitive adhesive label is configured by forming a heat sensitive adhesive layer normally exhibiting a non-adhesive property and exhibiting an adhesive property when heated and a printable surface on the bottom and top of a sheet-like label base material (e.g., base paper), respectively. The heat sensitive adhesive is mainly composed of a thermoplastic resin, a solid-state plasticizer, and the like and is characterized in that is exhibits a non-adhesive property at the room temperature but exhibits an adhesive property when heated and activated by a thermal activator. Normally, the activation temperature is in the range from 50 to 150° C., and the solid-state plasticizer in the heat sensitive adhesive is melted in that temperature range to impart the adhesive property to the thermoplastic resin. Since the solid-state plasticizer thus melted is gradually crystallized after being put in an over-cooled state, the adhesive property is maintained for a predetermined time, and the adhesive is used for applying something to an object such as a glass bottle while it has the adhesive property.

For example, a printable surface of a heat sensitive adhesive label is constituted of a heat sensitive coloring layer; and desired characters, images, and the like are printed thereon by a common thermal printer apparatus having a thermal head; and the heat sensitive adhesive layer is activated by the thermal activator.

Printer apparatus are under development in which the thermal activator is loaded in the thermal printer apparatus to allow heat sensitive printing on a heat sensitive label and activation of the heat sensitive adhesive layer to be performed continuously.

For example, such printer apparatus have had a configuration as shown in FIG. 17.

In FIG. 17, reference sign P2 represents a thermal printer unit; reference sign C2 represents a cutter unit; reference sign A2 represents a thermal activation unit; and reference sign R represents heat sensitive adhesive labels that are wound in the form of a roll.

The thermal printer unit P2 has a thermal head 100 for printing, a platen roller 101 that is urged into contact with said thermal head 100 for printing, and a driving system that is not shown (e.g., an electric motor, a gear train, and the like) for rotating the platen roller 101.

The platen roller 101 is rotated in a direction D1 (clockwise) in FIG. 17 to pull out a heat sensitive adhesive label R and to transport it in a direction D2 (to the right) after heat-sensitive printing is performed on the heat sensitive adhesive label R thus pulled out. The platen roller 101 also has pressing means that is not shown (e.g., a coil spring, a plate spring, or the like), and a surface of the platen roller 101 is urged by a repellent force of the same into contact with the thermal head 100. For example, the heat sensitive label R has a configuration as shown in FIG. 17.

Specifically, a thermal coat layer 501 as a heat sensitive coloring layer for forming a printable surface is provided on one side of base paper 500 as a label base material (on the top of the same in FIG. 18), and a color printing layer 502 having characters, patterns and the like of a frame of a price tag, a unit, and the like printed thereon is formed on the same. On the other side of the base paper 500 (the bottom of the same in FIG. 18), there is formed a heat sensitive adhesive layer K on which a heat sensitive adhesive mainly composed of a thermoplastic resin, a solid-state plasticizer, and the like is applied.

The thermal head 100 for printing and the platen roller 101 operate based on a printing signal from a printing controller that is, not shown, whereby printing can be performed as desired on the thermal coat layer 501 of the heat sensitive adhesive label R.

The cutter unit C2 is for cutting the heat sensitive adhesive label R that has been subjected to the heat sensitive printing by the thermal printer unit P2 into an appropriate length, and it is constituted of a movable blade 200 operated by a driving source (that is omitted in the illustration) such as an electric motor, a fixed blade 201, and the like. The movable blade 200 is operated at predetermined timing under control of a controller that is not shown.

For example, the thermal activation unit A2 is rotated by a driving source that is not shown, and it has a roller 300 for insertion and a roller 301 for ejection for inserting and ejecting the cut heat sensitive adhesive label R. A thermal head 400 for thermal activation and a platen roller 401 that is urged into contact with the thermal head 400 for thermal activation are disposed between the roller 300 for insertion and the roller 301 for ejection. The platen roller 401 has a driving system that is not shown (e.g., an electric motor, a gear train, and the like) and rotates the platen roller 401 in a direction D4 (counterclockwise in FIG. 17) to transport the heat sensitive adhesive label R in a direction D6 (to the right in FIG. 17) with the roller 300 for insertion and the roller 301 for ejection that rotate in a direction D3 and a direction D5. The platen roller 401 has pressing means that is not shown (e.g., a coil spring, a plate spring, or the like), and a surface of the platen roller 401 is urged into contact with the thermal head 400 for thermal activation by a repellent force of the same.

Reference sign S represents an ejection detecting sensor for detecting the ejection of the heat sensitive adhesive label R. The next heat sensitive adhesive label R is printed, transported, and thermally activated based on the detection of the ejection of the heat sensitive adhesive label R by the ejection detecting sensor S. The thermal head 400 for thermal activation and the platen roller 401 are operated at predetermined timing by a controller that is not shown, and the heat sensitive adhesive layer K of the heat sensitive adhesive label R is activated by heat applied by the thermal head 400 for thermal activation to exhibit adhesion.

After the heat sensitive adhesive label R is made adhesive by the thermal activation unit A2 having such a configuration, an operation of applying an indication label to a glass bottle such as a liquor or medicine bottle, a plastic container or the like or an operation of applying a price tag or advertising label is carried but. This is advantageous in that a cost reduction can be achieved because there is no need for a release sheet (liner) unlike a conventional and common adhesive label sheet and also advantageous in view of resource saving and environmental problems because there is no need for a release sheet that becomes a waste after use.

However, the thermal activation unit A2 for the conventional heat sensitive adhesive label R has had a problem in that the heat sensitive adhesive and a product of denaturation of the heat sensitive adhesive (a substance as a result of a chemical change or carbonization of the same due to heat) can adhere to the transport means for the heat sensitive adhesive label R (the platen roller 401, in particular).

Specifically, when a heat sensitive adhesive label R leaves the platen roller 401 after the heat sensitive adhesive layer K of the heat sensitive adhesive label R cut into a predetermined length by the cutter unit C2 is heated and activated by a heating element H of the thermal head 400 for thermal activation, as shown in FIG. 19(*a*), a part of the heat sensitive adhesive of the heat sensitive adhesive layer K is squeezed into the gap between the platen roller 401 and the thermal head 400 for thermal activation as a result of softening of the same attributable to heating, the part being thus released from the base paper 500 of the heat sensitive adhesive label R.

The platen roller 401 temporarily enters an idle running state as the heat sensitive adhesive label R is ejected, and heat sensitive adhesive G1 in a separated state as shown in FIG. 19(*a*) adheres to a circumferential surface of the platen roller 401 because of adhesion resulting from activation, as shown in FIG. 19(*b*).

After the states shown in FIGS. 19(*a*) and 19(*b*) are repeated a plurality of times, a multiplicity of lumps of the heat sensitive adhesive G1 adhere to the circumferential surface of the platen roller 401, as shown in FIG. 19(*c*). The heat sensitive adhesive G1 thus deposited is repeatedly heated by the thermal head 400 for thermal activation to be chemically changed or carbonized into a denatured product G2 that can rigidly adhere to the circumferential surface of the platen roller 401.

Further, since the heat sensitive adhesive G1 that has adhered to the circumferential surface of the platen roller 401 has a high adhesive force because it has been melted by being heated by the thermal head 400 for thermal activation a plurality of times, a part of the same can adhere to the top side of a heat sensitive adhesive label R that is transported to the same to smear and damage the printing surface thereof.

The smoothness of the circumferential surface of the platen roller 401 is reduced by the multiplicity of lumps of the heat sensitive adhesive G1 that adhere to the same, which has resulted in a problem in that the heat sensitive adhesive layer K of a heat sensitive adhesive label R transported thereto can not be uniformly heated and is therefore unable to exhibit sufficient adhesion.

SUMMARY OF THE INVENTION

The invention has been conceived to solve the above-described problems in the conventional art, and it is an object of the invention to provide a thermal activator for a heat sensitive adhesive sheet capable of preventing or eliminating adhesion of a heat sensitive adhesive and a denatured product of the heat sensitive adhesive to transport means for the heat sensitive adhesive sheet, and to a printer apparatus utilizing the thermal activator.

In order to achieve the object, a thermal activator for a heat sensitive adhesive sheet according to the present invention (a thermal activation unit A1) is a thermal activator for a heat sensitive adhesive sheet having at least heating means for activation (a thermal head 40 for thermal activation and a heating element H) for heating and activating a heat sensitive adhesive layer of a heat sensitive adhesive sheet (a heat sensitive adhesive label R) constituted of a printable surface (a thermal coat layer 501 and a color printing layer 502) and the heat sensitive adhesive layer (K) formed on one and another side of a sheet-like base material (base paper 500) respectively and transport means (a platen roller 41 for thermal activation and the like) for transporting the heat sensitive adhesive sheet in a predetermined direction. There is provided anti-adhesion means (sheet materials 81 and 600 for cleaning) for preventing the heat sensitive adhesive or a product of denaturation of the heat sensitive adhesive from adhering to the transport means.

This makes it possible to prevent a state in which the heat sensitive adhesive adheres to the transport means. It is therefore possible to avoid situations in which the printable surface is smeared and damaged or thermal activation becomes insufficient when the heat sensitive adhesive sheet is thermally activated by the thermal activator.

The anti-adhesion means may be constituted of a sheet material for cleaning interposed between a surface of a platen roller that constitutes the transport means and the printable surface of the heat sensitive adhesive sheet that is transported. Thus, since the platen roller urges the thermal head and the heat sensitive adhesive sheet through the sheet material for cleaning, the surface of the platen roller can be prevented from directing contacting the thermal head even during idle running of the same (when no heat sensitive adhesive sheet has reached the same), it is possible to prevent the heat sensitive adhesive that has adheres to the thermal head or the like from adhering to the platen roller.

The sheet material for cleaning may be configured such that it is paid out in the same direction as the direction in which the heat sensitive adhesive sheet is transported as a result of rotation of the platen roller. This allows the sheet material for cleaning to be paid out smoothly without interfering with the rotation of the platen roller.

The sheet material for cleaning may be wider than a lateral width of the thermal head. This makes it possible to reliably prevent the situation in which the heat sensitive adhesive adheres to the platen roller from the thermal head.

The sheet material for cleaning may be wound around a feed roller and a take-up roller that are provided in parallel with each other before and after the platen roller and that are rotatably disposed, and it may be sequentially paid out as a result of rotation of the platen roller. This eliminates the need for removing heat sensitive adhesive that has adhered to the sheet material for cleaning and makes it possible to reliably avoid the situation in which the printable surface of the heat sensitive adhesive sheet is smeared and damaged because a clean surface of the sheet material for cleaning is always in contact with the heat sensitive adhesive sheet.

The sheet material for cleaning is may be in the form of an endless belt, and a configuration is possible in which the sheet material for cleaning in the form of an endless belt is provided in parallel with the platen roller and is stretched between a driven roller and the same to be circulated. This makes it possible to reliably avoid the situation in which the printable surface of the heat sensitive adhesive sheet is smeared and damaged and to reduce the running cost through a reduction of the frequency of replacement of the sheet material for cleaning because the sheet material for cleaning in the form of an endless belt is circulated and reused.

The sheet material for cleaning in the form of an endless belt may further have a knife-shaped member (scraper) that slides in contact with a surface of the sheet material to scrape the heat sensitive adhesive and the product of denaturation of the heat sensitive adhesive that have adhered to the surface. Since the heat sensitive adhesive and the product of denaturation of the heat sensitive adhesive that have adhered to the sheet material for cleaning can be removed by scraping them with the knife-shaped member, it is possible to reliably avoid the situation in which the printable surface of the heat sensitive adhesive sheet is smeared and damaged. The sheet material for cleaning in the form of an endless belt may further have a transfer material which slides in contact with a surface of the sheet material and to which the heat sensitive adhesive and the product of denaturation of the heat sensitive adhesive that have adhered to the surface are transferred. Since the heat sensitive adhesive and the product of denaturation of the heat sensitive adhesive that have adhered to the sheet material for cleaning can be removed by transferring them to the transfer material, it is possible to reliably avoid the situation in which the printable surface of the heat sensitive adhesive sheet is smeared and damaged.

The sheet material for cleaning and the transfer material may be constituted of any of rubber, resin, paper, synthetic paper, and cloth. This makes it possible to reliably remove the heat sensitive adhesive and the product of denaturation of the heat sensitive adhesive that have adhered to the thermal head or platen roller.

Another thermal activator for a heat sensitive adhesive sheet according to the present invention (a thermal activation unit A1) is a thermal activator for a heat sensitive adhesive sheet having at least heating means for activation (a thermal head 40 for thermal activation and a heating element H) for heating and activating a heat sensitive adhesive layer of a heat sensitive adhesive sheet (a heat sensitive adhesive label R) constituted of a printable surface (a thermal coat layer 501 and a color printing layer 502) and the heat sensitive adhesive layer (K) formed on one and another side of a sheet-like base material (base paper 500) respectively and transport means (a platen roller 41 for thermal activation and the like) for transporting the heat sensitive adhesive sheet in a predetermined direction. There is provided removal means (a scraper 50, a rotary body 610 having a spiral groove or protrusion, a rotary body 700 having a spiral blade, wires W, scraping tools 900 and 1100 in the form of a cutter blade, a transfer material 60, a cleaning roller 70, or the like) for removing the heat sensitive adhesive or a product of denaturation of the heat sensitive adhesive that have adhered to the transport means.

This makes it possible to prevent the state in which the heat sensitive adhesive adheres to the transport means. Therefore, the situation in which the printable surface is smeared and damaged and thermal activation becomes insufficient can be avoided when the heat sensitive adhesive sheet is thermally activated by the thermal activator.

The removal means may be constituted of scraping means that slides in contact with a surface of a platen roller constituting the transport means to scrape the heat sensitive adhesive and a product of denaturation of the heat sensitive adhesive that have adhered to the surface of the platen roller. Since the heat sensitive adhesive and the product of denaturation of the heat sensitive adhesive that have adhered to the platen roller can be scraped even if the heat sensitive adhesive adheres to transport means, it is possible to keep the surface of the platen roller clean.

The scraping means may be constituted of a knife-shaped member which slides in the axial direction of a circumferential surface of the platen roller in contact with the same. This makes it possible to scrape the heat sensitive adhesive and the product of denaturation of the heat sensitive adhesive with a relatively simple configuration. According to this method, since high frictional resistance can occur during rotation of the platen roller because of a relatively large contact area between the circumferential surface of the platen roller and the knife-shaped member, it is desirable to take actions such as increasing the driving torque of the platen roller.

The scraping means may be constituted of a rotary body having a spiral groove or protrusion which slides in the axial direction of the circumferential surface of the platen roller in contact with the same. This makes it possible to scrape the heat sensitive adhesive and the product of denaturation of the heat sensitive adhesive with a relatively simple configuration. According to this method, since the circumferential surface of the platen roller and the rotary body having a spiral groove or protrusion contact with each other in a condition similar to point contact and the contact area is therefore relatively small, there is not so high frictional resistance during rotation of the platen roller, this advantageously eliminates the need for daringly increasing the driving torque of the platen roller. Since the rotary body with a spiral groove or protrusion itself has elasticity, there is an advantage in that there is no need for providing separate pressing means for urging the rotary body into contact with the circumferential surface of the platen roller.

The rotary body having a spiral groove or protrusion may be rotated in a direction that is the same as or opposite to the rotating direction of the platen roller or in a rotating pattern that is a combination of the same and opposite directions. For example, the spiral protrusion may be configured by winding a wire around a cylindrical body. This makes it possible to efficiently scrape the heat sensitive adhesive and the product of denaturation of the heat sensitive adhesive that have adhered to the circumferential surface of the platen roller.

The scraping means may be constituted of a cylindrical rotary body having a spiral blade which slides in the axial direction of a circumferential surface of the platen roller in contact with the same. This makes it possible to scrape the heat sensitive adhesive and the product of denaturation of the heat sensitive adhesive with a relatively simple configuration. According to this method, since the circumferential surface of the platen roller and the rotary body contact with each other in a condition similar to point contact at the edge of the spiral blade and the contact area is therefore relatively small, there is not so high frictional resistance during rotation of the platen roller, this advantageously eliminates the need for daringly increasing the driving torque of the platen roller.

The cylindrical rotary body having a spiral blade may be rotated in a direction that is the same as or opposite to the rotating direction of the platen roller or in a rotating pattern that is a combination of the same and opposite directions. This makes it possible to efficiently scrape the heat sensitive adhesive and the product of denaturation of the heat sensitive adhesive that have adhered to the circumferential surface of the platen roller.

The cylindrical rotary body having a spiral blade may have pressing means for pressing the rotary body against the circumferential surface of the platen roller. This makes it possible to press the spiral blade against the circumferential surface of the platen roller with appropriate tension and to efficiently scrape the heat sensitive adhesive and the product of denaturation of the heat sensitive adhesive without interfering with the rotation of the platen roller.

The scraping means may be constituted of a plurality of wires stretched at an angle to the axial direction of the circumferential surface of the platen roller. This makes it possible to scrape the heat sensitive adhesive and the product of denaturation of the heat sensitive adhesive with a relatively simple configuration. According to this method, since the area of contact with the circumferential surface of the platen roller can be adjusted based on the number of the wires to prevent a significant increase in the frictional resistance during rotation of the platen roller, there is an advantage in that it is not necessary to dare to increase the driving torque of the platen roller.

Each of the wire may have pressing means for pressing the wire against the circumferential surface of the platen roller with predetermined tension. Since this makes it possible to press the wire against the circumferential surface of the platen roller with appropriate tension, the heat sensitive adhesive and the product of denaturation of the heat sensitive adhesive can be more efficiently scraped without any interference with the rotation of the platen roller.

The scraping means may be constituted of a scraping tool in the form of a cutter blade whose blade surface slides in contact with a circumferential of the platen roller; and the scraping tool may have driving means for moving the scraping tool back and forth in the axial direction of the platen roller. This makes it possible to scrap the heat sensitive adhesive and the product of denaturation of the heat sensitive adhesive with a relatively simple configuration.

The driving means may be constituted of a ball screw having a spiral guide groove which is engaged with a slider provided at the scraping tool and rotating means for rotating the ball screw; the rotating means may have control means for allowing switching between forward rotation and reverse rotation; and the rotating means may be switched between forward rotation and reverse rotation at predetermined timing under control of the control means to move the scraping tool back and forth in the axial direction of the platen roller. This makes it possible to efficiently scrape the heat sensitive adhesive and the product of denaturation of the heat sensitive adhesive.

The driving means may be constituted of a ball screw having two spiral guide grooves which are engaged with the slider provided at the scraping tool and which intersect with each other and rotating means for rotating the ball screw; and the slider may be moved under the guidance of the guide grooves as a result of rotation of the ball screw to move the scraping tool back and forth in the axial direction of the platen roller. This makes it possible to efficiently scrape the heat sensitive adhesive and the product of denaturation of the heat sensitive adhesive with a simple configuration.

The driving means may be constituted of a wrapping connection mechanism, and the wrapping connection mechanism may be rotated in a forward or reverse direction at predetermined timing to move the scraping tool back and forth in the axial direction of the platen roller. This makes it possible to efficiently scrape the heat sensitive adhesive and the product of denaturation of the heat sensitive adhesive.

The removal means may be constituted of a knife-shaped member which slides in contact with the surface of the platen roller constituting the transport means to scrape the heat sensitive adhesive and the product of denaturation of the heat sensitive adhesive that have adhered to the surface of the platen roller. Since this makes it possible to remove the heat sensitive adhesive and the product of denaturation of the heat sensitive adhesive that have adhered to the platen roller by scraping them with the knife-shaped member, it is possible to reliably avoid a situation in which the printable surface of the heat sensitive adhesive sheet is smeared and damaged.

The removal means may be constituted of a transfer material which slides in contact with the surface of the platen roller constituting the transport means and to which the heat sensitive adhesive and the product of denaturation of the heat sensitive adhesive that have adhered to the surface of the platen roller are transferred. Since this makes it possible to remove the heat sensitive adhesive and the product of denaturation of the heat sensitive adhesive that have adhered to the platen roller by transferring them to the transfer material, it is possible to reliably avoid a situation in which the printable surface of the head sensitive adhesive sheet is smeared and damaged.

The removal means may be constituted of a cylindrical cleaning roll which is rotated such that a circumferential surface thereof contacts the surface of the platen roller constituting the transport means to adsorb the heat sensitive adhesive and the product of denaturation of the heat sensitive adhesive that have adhered to the surface of the platen roller. Since this makes it possible to remove the heat sensitive adhesive and the product of denaturation of the heat sensitive adhesive that have adhered to the platen roller by adsorbing them with the cleaning roll, it is possible to reliably avoid a situation in which the printable surface of the heat sensitive adhesive sheet is smeared and damaged.

The cleaning roll is preferably constituted of any of natural rubber, synthetic natural rubber, urethane rubber, silicon rubber, and fluoro rubber or any of phenol resin, epoxy resin, polyester resin, silicon resin, acryl resin, vinyl chloride, and polyethylene resin. This makes it possible to reliably remove the heat sensitive adhesive or the product of denaturation of the heat sensitive adhesive that have adhered to the platen roller. The knife-shaped member may be constituted of any of rubber, plastic, or metal or rubber, plastic, or metal whose surface is fluororesin-processed.

The cleaning roll may further have a knife-shaped member that slides in contact with a surface of the cleaning roll to scrape the heat sensitive adhesive and the product of denaturation of the heat sensitive adhesive that have adhered to the surface of the platen roller. Since this makes it possible to remove the heat sensitive adhesive and the product of denaturation of the heat sensitive adhesive that have been adsorbed to the surface of the cleaning roll by scraping them with the knife-shaped member, the platen roller can be cleaned with improved reliability.

The cleaning roll may further have a transfer material which slides in contact with the surface of the cleaning roll and to which the heat sensitive adhesive and the product of denaturation of the heat sensitive adhesive that have adhered to the surface of the platen roller are transferred. Since this makes it possible to remove the heat sensitive adhesive and the product of denaturation of the heat sensitive adhesive that have been adsorbed to the surface of the cleaning roll by transferring them to the transfer material, the platen roller can be cleaned with improved reliability.

A printer apparatus according to another invention has a thermal activator for a heat sensitive adhesive sheet as described above. As a result, it is possible to provide a printer apparatus for a heat sensitive adhesive sheet in which a printable surface of a heat sensitive adhesive sheet will not be smeared and damaged and which can sufficiently activate a heat sensitive adhesive layer to realize uniform adhesion.

It may also have a thermal head which performs printing by contacts a heat sensitive coloring layer of a heat sensitive adhesive sheet having a printable surface on which the heat sensitive coloring layer is formed. This makes it possible to print a heat sensitive adhesive sheet using a heat sensitive method utilizing a thermal head.

BRIEF DESCRIPTION OF THE DRAWINGS

For a more better understanding of the present invention, reference is made of a detailed description to be read in conjunction with the accompanying drawings, in which:

FIGS. 3A and 3B are a perspective view and a schematic plan view, respectively, showing an embodiment in which a rotary body having a spiral groove or protrusion is provided as the means for removing a heat sensitive adhesive and the like in the thermal activation unit;

FIGS. 4A-4B are a perspective view and a schematic plan view, respectively, showing an embodiment in which a rotary body having a screw blade is provided as the means for removing a heat sensitive adhesive and the like in the thermal activation unit;

DETAILED DESCRIPTION OF THE PREFERRED EMBODIMENTS

A preferred mode for carrying out the present invention will now be described based on the drawings.

Figure 1:
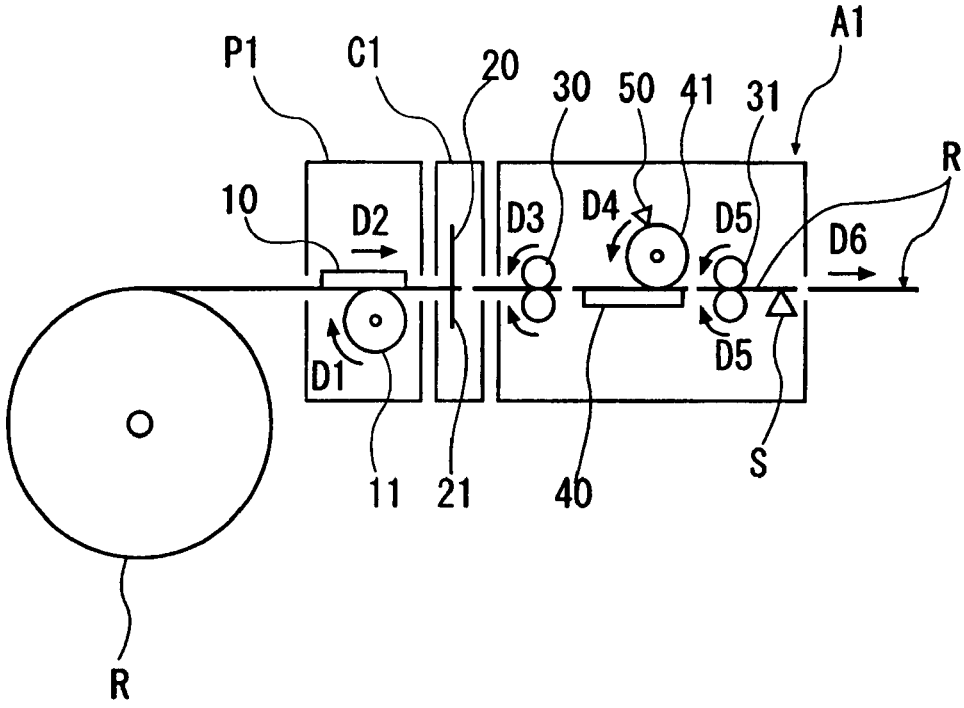
FIG. 1 is a schematic diagram showing a configuration of a thermal printer apparatus according to the present invention.

FIG. 1 is a schematic diagram showing a configuration of a thermal printer apparatus according to the present invention. In FIG. 1, reference sign P1 represents a thermal printer unit; reference sign C1 represents a cutter unit; reference sign A1 represents a thermal activation unit as a thermal activator; and reference sign R represents heat sensitive adhesive labels that are wound in the form of a roll.

The thermal printer unit P1 has a common configuration and has a thermal head 10 for printing, a platen roller 11 that is urged into contact with the thermal head 10 for printing, and a driving system that is not shown for rotating the platen roller 11 (e.g., an electric motor, a gear train, and the like).

The platen roller 11 is rotated in a direction D1 (clockwise) in FIG. 1 to pull out a heat sensitive adhesive label R, and the heat sensitive adhesive label R thus pulled out is transported in a direction D2 (to the right) after performing heat sensitive printing on the same. The platen roller 11 has pressing means that is not shown (e.g., a coil spring, a plate spring, or the like), and a surface of the platen roller 11 is urged into contact with the thermal head 10 for printing by a repellent force of the same.

Figure 18:
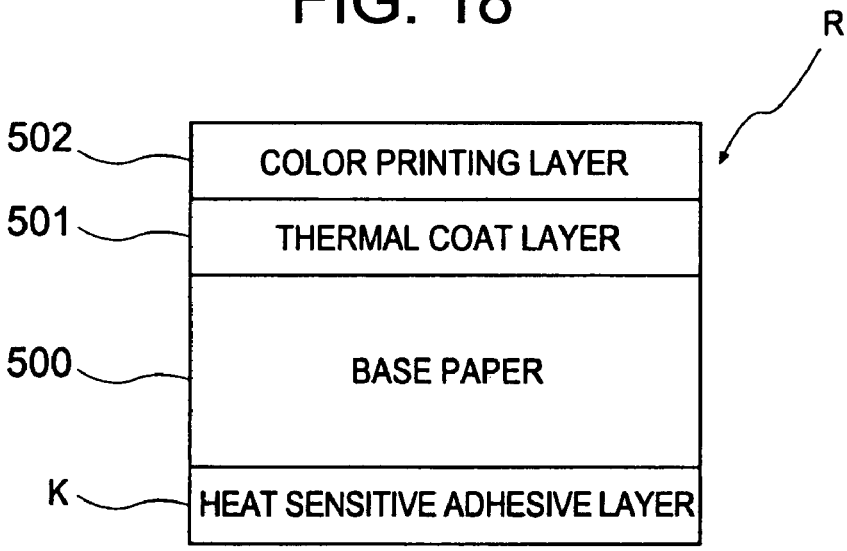
FIG. 18 is a sectional view showing an example of a configuration of a heat sensitive adhesive sheet.

A heating element of the thermal head 10 for printing is constituted of a plurality of relatively small resistors that are arranged side by side in the direction of the width of the head to allow dot printing. Referring to a heating element H of a thermal head 40 for thermal activation to be described later, it may be a continuous resistor because there is no need for dividing it into dots as done for the purpose of printing. Resistors having the same configuration may be used for both of the thermal head 10 for printing and the thermal head 40 for thermal activation to achieve a cost reduction through use of the common part. For example, a heat sensitive adhesive label R used in the present mode for carrying out the invention has a configuration as shown in FIG. 18 described above. A thermal insulation layer may be provided on base paper 500 as occasions demand.

The thermal head 10 for printing and the platen roller 11 operate based on a printing signal from a printing controller that is not shown, whereby printing can be performed as desired on a thermal coat layer 501 of a heat sensitive adhesive label R.

The cutter unit C1 is for cutting the heat sensitive adhesive label R that has been subjected to the heat sensitive printing by the thermal printer unit P1 into an appropriate length, and it is constituted of a movable blade 20 operated by a driving source (that is omitted in the illustration) such as an electric motor, a fixed blade 21, and the like. The movable blade 20 is operated at predetermined timing under control of a controller that is not shown.

For example, the thermal activation unit A1 is rotated by a driving source that is not shown, and it has a roller 30 for insertion and a roller 31 for ejection for inserting and ejecting the cut heat sensitive adhesive label R. A thermal head 40 for thermal activation and a platen roller 41 for thermal activation that is urged into contact with the thermal head 40 for thermal activation are disposed between the roller 30 for insertion and the roller 31 for ejection. The platen roller 41 for thermal activation has a driving system that is not shown (e.g., an electric motor, a gear train, and the like) and rotates the platen roller 41 for thermal activation in a direction D4 (counterclockwise in FIG. 1) to transport the heat sensitive adhesive label R in a direction D6 (to the right in FIG. 1) with the roller 30 for insertion and the roller 31 for ejection that rotate in a direction D3 and a direction D5. The platen roller 41 for thermal activation has pressing means that is not shown (e.g., a coil spring, a plate spring, or the like), and a surface of the platen roller 41 for thermal activation is urged into contact with the thermal head 40 for thermal activation by a repellent force of the same. The platen roller 41 for thermal activation is constituted of hard rubber or the like, for example.

Reference sign S represents an ejection detecting sensor for detecting the ejection of the heat sensitive adhesive label R. The next heat sensitive adhesive label R is printed, transported, and thermally activated based on the detection of the ejection of the heat sensitive adhesive label R by the ejection detecting sensor S.

Figure 2:
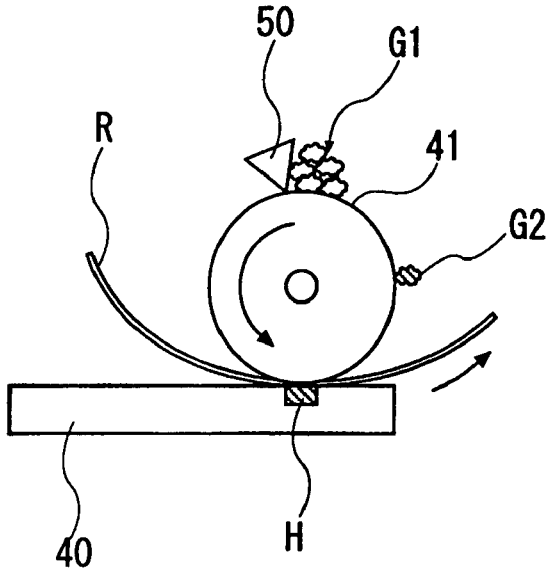
FIG. 2 is a schematic configuration diagram showing an embodiment in which a knife-shaped member is provided as means for removing a heat sensitive adhesive and the like in a thermal activation unit.

Reference numeral 50 represents a knife shaped member (scraper) as means for removing heat sensitive adhesive G1 that has adhered to the platen roller 41 for thermal activation. For example, the scraper 50 shown in FIG. 2 is constituted of rubber, plastic, metal or rubber, plastic, or metal whose surface is fluororesin-processed and is formed with a width slightly greater than a lateral width of the platen roller 41 for thermal activation. The scraper 50 is urged by urging means that is not shown into contact with a surface of the platen roller 41 for thermal activation.

When the thermal printer apparatus starts operating, the thermal printer unit P1 first performs heat sensitive printing on a printable surface (the thermal coat layer 501) of a heat sensitive adhesive label R. Then, the heat sensitive adhesive label R that has been transported to the cutter unit C1 as a result of rotation of the platen roller 11 for printing is cut into a predetermined length by the movable blade 20 that operates at predetermined timing.

Subsequently, the cut heat sensitive adhesive label R is taken into the thermal activation unit A1 by the roller 30 for insertion of the thermal activation unit A1, and thermal energy is applied to the same by the thermal head 40 (heating element H) and the platen roller 41 for thermal activation operated at predetermined timing by controllers that is not shown. As a result, a heat sensitive adhesive layer K of the heat sensitive adhesive label R is activated to exhibit adhesion. Next, it is ejected from the thermal printer apparatus by an operation of the roller 31 for ejection.

Figure 19A:
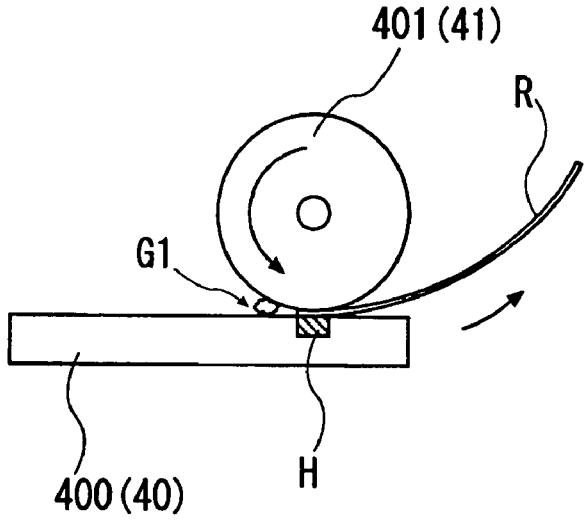
FIG. 19A PRIOR ART
FIGS. 19A-19C are illustrations showing how a heat sensitive adhesive and the like adhere to conventional thermal activator.
Figure 19B:
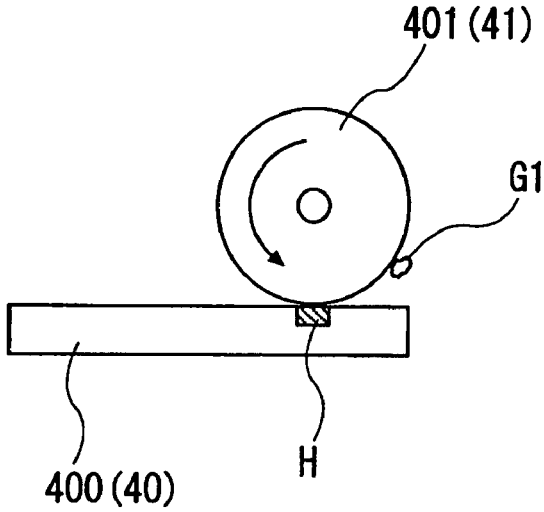
FIG. 19B PRIOR ART
Figure 19C:
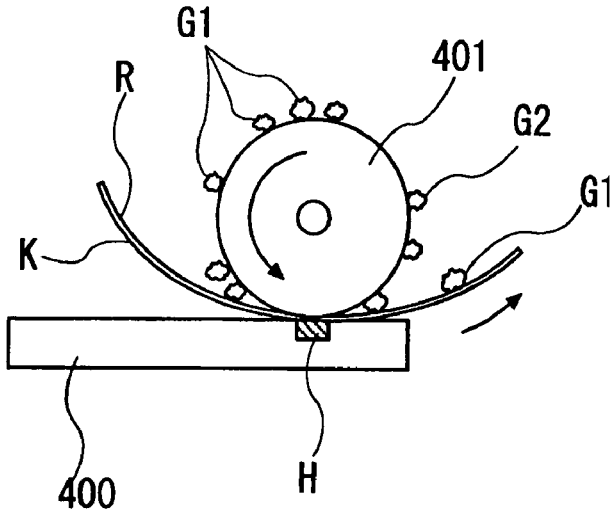
FIG. 19C PRIOR ART

When the heat sensitive adhesive label R leaves the platen roller 41 for thermal activation after the heat sensitive adhesive layer K of the heat sensitive adhesive label R is heated and activated by the heating element H of the thermal head 40 for thermal activation, a part of the heat sensitive adhesive of the heat sensitive adhesive layer K is squeezed into the gap between the platen roller 41 for thermal activation and the thermal head 40 for thermal activation as a result of softening of the same attributable to heating, the part being thus released from the base paper 500 of the heat sensitive adhesive label R (see FIG. 19(*a*)).

The platen roller 41 for thermal activation temporarily enters an idle running state as the heat sensitive adhesive label R is ejected, and heat sensitive adhesive G1 in a separated state as shown in FIG. 19(*a*) adheres to a circumferential surface of the platen roller 41 for thermal activation because of adhesion resulting from activation (see FIG. 19(*b*)).

In the thermal activation unit A1 according to the present mode for carrying out the invention, the heat sensitive adhesive G1 and a product G2 of denaturation of the heat sensitive adhesive that have adhered to a circumferential surface of the platen roller 41 for thermal activation are scraped from the circumferential surface of the platen roller 41 for thermal activation by the operation of the scraper 50, as shown in FIG. 2.

This makes it possible to reliably remove the heat sensitive adhesive G1 and the product G2 of denaturation of the heat sensitive adhesive that have adhered to the platen roller 41 for thermal activation as transport means. It is therefore possible to avoid situations in which the printable surface (a surface of a color printing layer, 502) of the next heat sensitive adhesive label R transported is smeared and damaged during thermal activation of the same by the thermal activation unit A1 and in which the heat sensitive adhesive G1 and the product G2 of denaturation of the heat sensitive adhesive are deposited on the circumferential surface of the platen roller 41 for thermal activation to make the contact with the thermal head 40 for thermal activation ununiform and to thereby make the thermal activation insufficient.

The scraper 50 is desirably periodically cleaned or replaced in order to prevent the heat sensitive adhesive G1 and the product G2 of denaturation of the heat sensitive adhesive that have adhered to the scraper 50 from adhering to the platen roller 41 for thermal activation again.

The means for removing the heat sensitive adhesive G1 that has adhered to the platen roller 41 for thermal activation is not limited to the scraper 50 described above.

FIG. 3 shows an embodiment in which a rotary body 610 having a spiral groove or protrusion is provided in place of the scraper 50. FIG. 3(*a*) is a perspective view showing a state in which the platen roller 41 and the rotary body 610 having a spiral groove or protrusion slidably contact each other, and FIG. 3(*b*) is a schematic view of the same taken from above.

The rotary body 610 having a spiral groove or protrusion is configured by winding a wire C around a roller 601 having a rotating shaft 602 in the form of a coil (in the form of a spiral). An end of the wire C is fixed to the roller 601 such that the wire C is rotated along with the roller 601 when the roller 601 is rotated by a driving source which is not shown through the rotating shaft 602. The wire C is wound around the roller 601 over a range that is slightly longer than the platen roller 41 such that the entire circumferential surface of the platen roller 41 can be cleaned.

The rotary body 610 having a spiral groove or protrusion is provided in parallel with the platen roller 41 and is urged by urging means (e.g., a plate spring or the like) which is not shown into slidable contact with the circumferential surface of the platen roller 41. At this time, an outer circumferential section of the rotary body 610 having a spiral groove or protrusion and the circumferential surface of the platen roller 41 contact each other at a point-like contact portion S1 through the wire C. The contact portion S1 moves in the axial direction of the platen roller 41 as the rotary body 610 rotates.

Thus, when the platen roller 41 and the rotary body 610 having a spiral groove or protrusion are rotated, the outer circumferential section of the wire C can scrape and remove the heat sensitive adhesive G1 and the product G2 of denaturation of the heat sensitive adhesive that have adhered to the circumferential surface of the platen roller 41 while contacting them at the point-like contact portion S1.

While the platen roller 41 and the rotary body 610 are rotated in the same direction in the example shown in FIG. 3, this is not limiting, and the rotating direction of the driving source of the rotary body 610 having a spiral groove or protrusion may be switched at predetermined timing to rotate it in a direction that is the same as or opposite to the rotating direction of the platen roller 41 or in a rotating pattern that is a combination of the same and opposite directions. It is anticipated that this will make it possible to remove the heat sensitive adhesive G1 and the product G2 of denaturation of the heat sensitive adhesive more efficiently.

The heat sensitive adhesive G1 and the product G2 of denaturation of the heat sensitive adhesive scraped from the platen roller 41 adhere to the outer circumferential surface of the wire C and the circumferential surface of the roller 601 to be gradually deposited there on as a result of the operation of the rotary body 610 having a spiral groove or protrusion, and it is therefore desirable to clean them at every predetermined period.

Although there is no particular limitation on the sectional configuration of the wire C, an improvement in the scraping effect may be expect from the use of a triangular or polygonal wire instead of a normal round configuration.

FIG. 4 shows an embodiment in which a cylindrical rotary body 700 having a spiral (spiral) blade is provided in place of the scraper 50. FIG. 4(*a*) is a perspective view showing a state in which the platen roller 41 and the rotary body 700 FIG. 4 slidably contact each other, and FIG. 4(*b*) is a schematic view of the same taken from above.

The rotary body 700 is provided by forming a spiral blade 702 on a circumferential surface of a rod-shaped body 701 that also serves as a rotating shaft. The spiral wire blade 702 is formed on the rod-shaped body 701 over a range that is set at a length equal to or slightly greater than the platen roller 41 such that the entire circumferential surface of the platen roller 41 can be cleaned.

The rotary body 700 is provided in parallel with the platen roller 41, and the edge of the spiral blade 702 is urged by urging means (e.g., a plate spring or the like) which is not shown into slidable contact with the circumferential surface of the platen roller 41. At this time, the spiral blade 702 and the circumferential surface of the platen roller 41 contact each other at a point-like contact portion S2 through the edge of the blade. The contact portion S2 moves in the axial direction of the platen roller 41 as the rotary body 700 rotates.

Thus, when the platen roller 41 and the rotary body 700 are rotated, the edge of the spiral blade 702 can scrape and remove the heat sensitive adhesive G1 and the product G2 of denaturation of the heat sensitive adhesive that have adhered to the circumferential surface of the platen roller 41 while contacting them at the point-like contact portion S2.

While the platen roller 41 and the rotary body 700 are rotated in the same direction in the example shown in FIG. 4, this is not limiting, and the rotating direction of the driving source of the rotary body 700 may be switched at predetermined timing to rotate it in a direction that is the same as or opposite to the rotating direction of the platen roller 41 or in a rotating pattern that is a combination of the same and opposite directions. It is anticipated that this will make it possible to remove the heat sensitive adhesive G1 and the product G2 of denaturation of the heat sensitive adhesive more efficiently.

The heat sensitive adhesive G1 and the product G2 of denaturation of the heat sensitive adhesive scraped from the platen roller 41 adhere to the spiral blade 702 and a circumferential surface of the rod-shaped body 701 to be gradually deposited thereon as a result of the operation of the rotary body 700, and it is therefore desirable to clean them at every predetermined period.

Figure 5A:
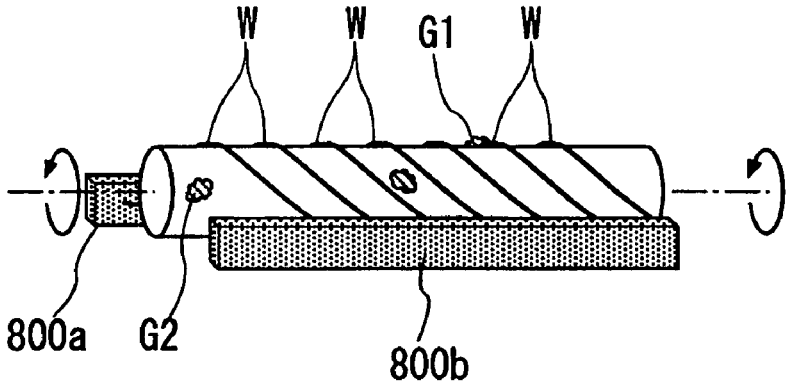
FIGS. 5A-5C are a perspective view, a side view, and a schematic plan view, respectively, showing an embodiment in which a plurality of wires are stretched as the means for removing a heat sensitive adhesive and the like in the thermal activation unit.
Figure 5B:
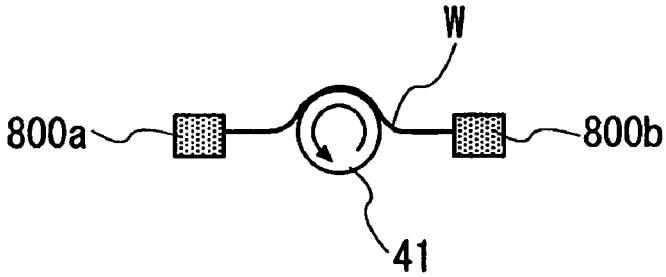
Figure 5C:
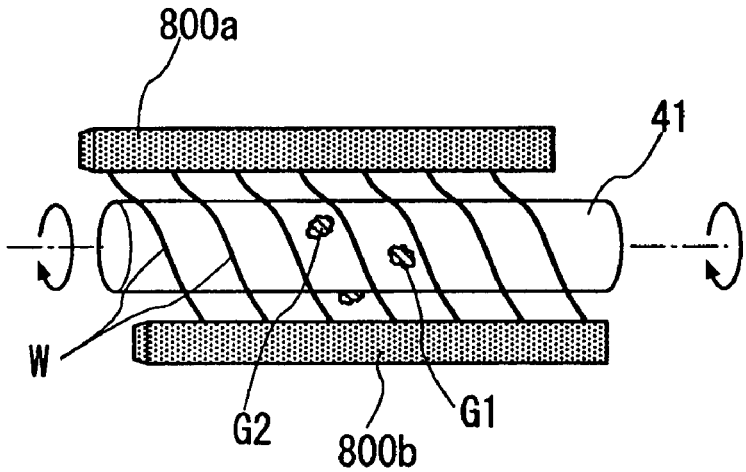

FIG. 5 shows an embodiment in which a plurality of wires W are stretched in place of the scraper 50. FIG. 5(*a*) is a perspective view showing a state in which the platen roller 41 and the wires Ware engaged with each other; FIG. 5(*b*) is a schematic view of the same taken sideways; and FIG. 5(*c*) is a schematic view of the same taken from above. Each of the wires W is stretched at an angle to the axial direction of the circumferential surface of the platen roller 41 and is fixed with a pair of fixing tools 800*a* and 800*b*. For example, mechanisms for tensioning each wire W using a spring or the like may be provided in each of the fixing tools 800*a* and 800*b* to urge each wire W against the circumferential surface of the platen roller 41.

Thus, when the platen roller 41 is rotated, each of the wires W stretched at an angle thereto can scrape and remove the heat sensitive adhesive G1 and the product G2 of denaturation of the heat sensitive adhesive that have adhered to the circumferential surface of the platen roller 41. It is desirable to clean each of the wires W at every predetermined period because the heat sensitive adhesive G1 and the product G2 of denaturation, of the heat sensitive adhesive scraped from the platen roller 41 gradually adhere to the same.

Although there is no particular limitation on the sectional configuration of the wires W, an improvement in the scraping effect may be expect from the use of a triangular or polygonal wire instead of a normal round configuration.

Figure 6A:
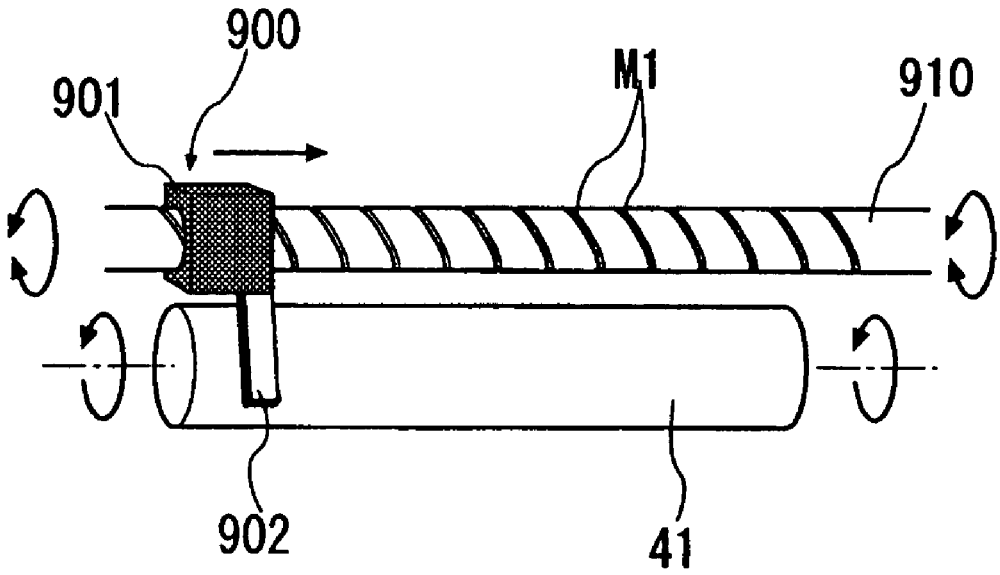
FIGS. 6A-6B are a perspective view and a schematic plan view, respectively, showing an embodiment in which a scraping tool in the form of a cutter blade is used as the means for removing a heat sensitive adhesive and the like in the thermal activation unit and in which a ball screw is used as driving means.
Figure 6B:
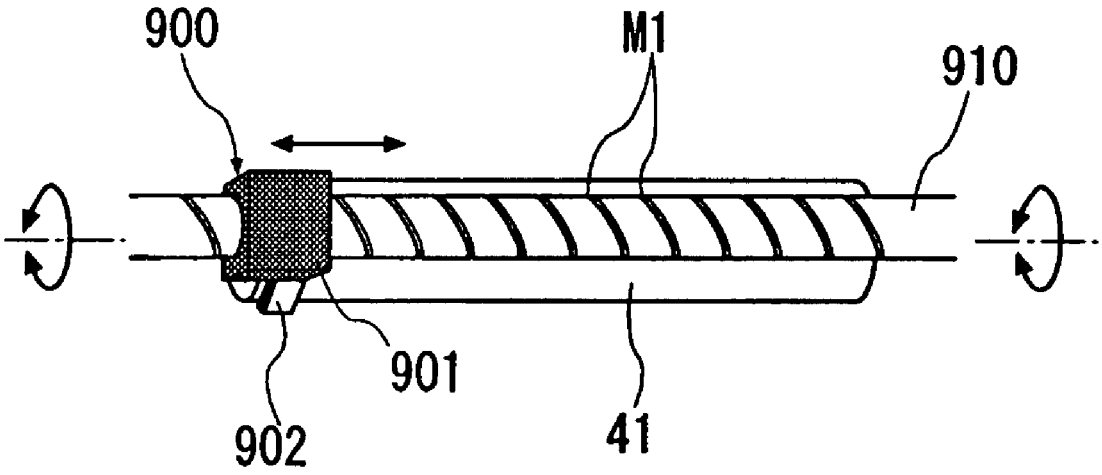

FIG. 6 shows an embodiment in which a scraping tool 900 in the form of a cutter blade is provided in place of the scraper 50 such that it can be moved back and forth. FIG. 6(*a*) is a perspective view showing a state in which the platen roller 41 and the scraping tool 900 are engaged with each other, and FIG. 6(*b*) is a schematic view of the same taken from above.

The scraping toll 900 is constituted of a slider 901 that also serves as a fixing toll for a cutter blade 902 and a ball screw 910 having one spiral guide groove M1 for moving the slider 901 horizontally. The ball screw 910 is set at a length equal to or slightly greater than the platen roller 41 such that the entire circumferential surface of the platen roller 41 can be cleaned.

The ball screw 910 is provided in parallel with the platen roller 41 and is forward- or reverse-rotated by a driving source that is not shown.

The slider 901 of the scraping tool 900 is engaged with the ball screw 910 and is disposed such that it can be horizontally moved in the axial direction of the platen roller 41 along the spiral guide groove M1. The edge of the cutter blade 902 is adjusted to a position in which it slides in contact with the platen roller 41. Thus, when the platen roller 41 and the ball screw 910 are rotated, the edge of the cutter blade 902 of the scraping tool 900 can scrape and remove the heat sensitive adhesive G1 and the product G2 of denaturation of the heat sensitive adhesive that have adhered to the circumferential surface of the platen roller 41 while moving horizontally in the axial direction of the platen roller 41.

The scraping tool 900 can be moved back and forth in the axial direction of the platen roller 41 by switching the rotating direction of the ball screw 910 at predetermined timing. The heat sensitive adhesive G1 and the product G2 of denaturation of the heat sensitive adhesive scraped from the platen roller 41 adhere to the scraping-tool 900 and the cutter blade 902 to be gradually deposited thereon, and it is therefore desirable to clean them at every predetermined period.

Figure 7A:
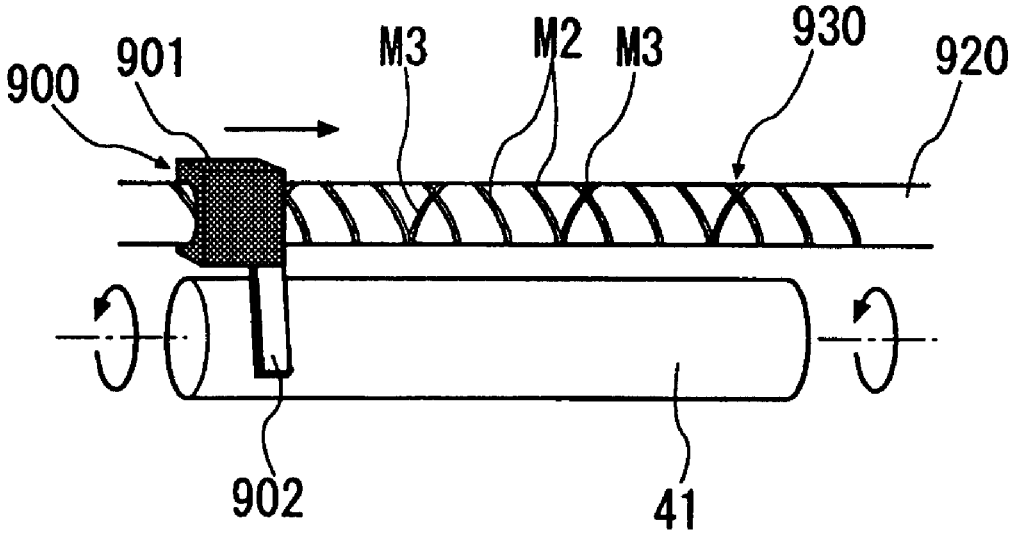
FIGS. 7A-7B are a perspective view and a schematic plan view, respectively, showing another embodiment in which a scraping tool in the form of a cutter blade is used as the means for removing a heat sensitive adhesive and the like in the thermal activation unit and in which a ball screw is used as driving means.
Figure 7B:
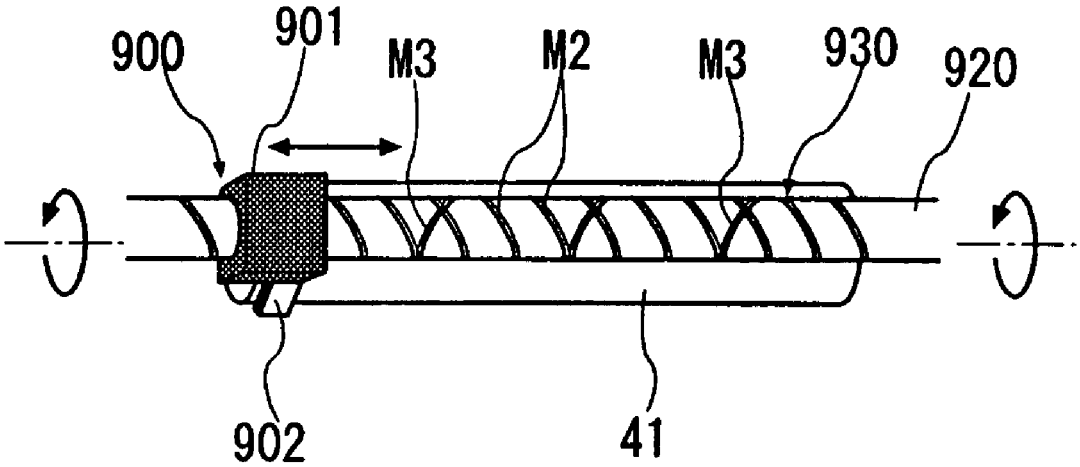

FIG. 7(*a*) shows an embodiment in which a ball screw 920 having a lead screw 930 constituted of two spiral guide grooves M2 and M3 intersecting with each other is used in place of the ball screw 910 in FIG. 6. Thus, the scraping tool 900 can be moved back and forth in the axial direction of the platen roller 41 only by rotating the ball screw 930 as shown in FIG. 7(*b*), and this makes it possible to scrape and remove the heat sensitive adhesive G1 and the product G2 of denaturation of the heat sensitive adhesive that have adhered to the circumferential surface of the platen roller 41 with a simple configuration.

Figure 8A:
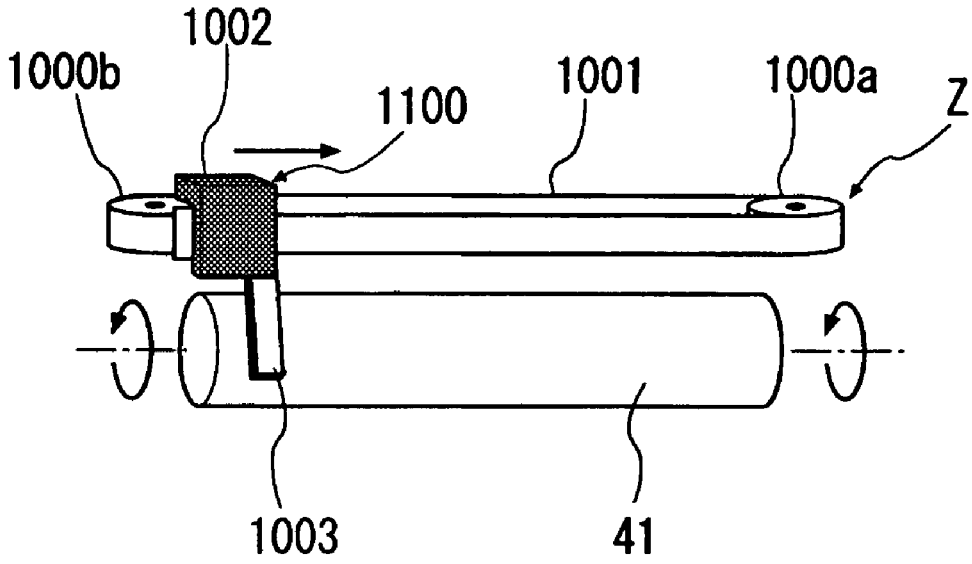
FIGS. 8A-8B are a perspective view and a schematic plan view, respectively, showing an embodiment in which a scraping tool in the form of a cutter blade is used as the means for removing a heat sensitive adhesive and the like in the thermal activation unit and in which a wrapping connection mechanism is used as driving means.
Figure 8B:
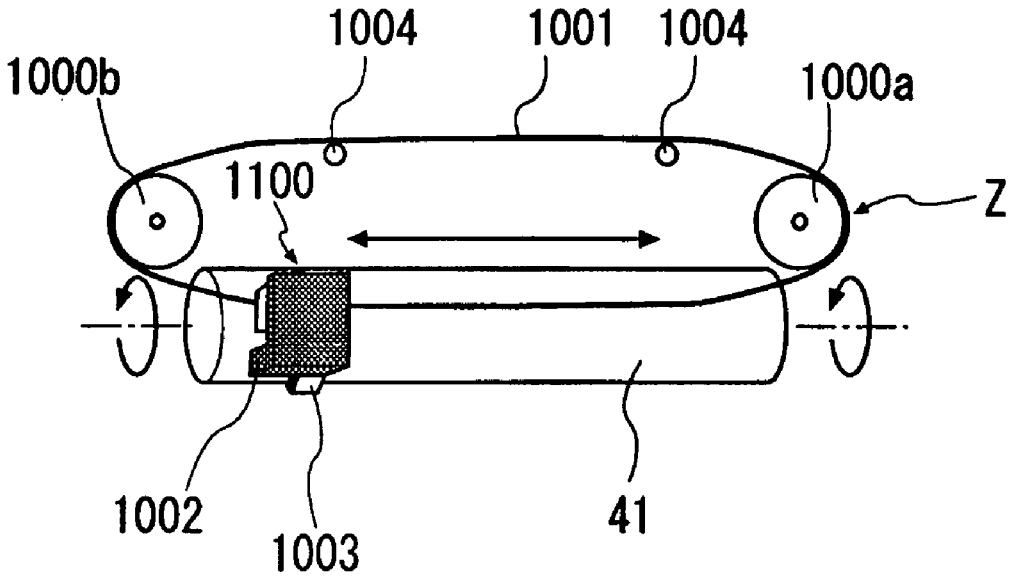

FIG. 8 shows an embodiment in which a wrapping connection mechanism Z for horizontally moving a scraping tool 1100 is provided in place of the ball screw 910 in FIG. 6 and the ball screw 930 shown in FIG. 7. FIG. 8(*a*) is a perspective view showing a disposition of the platen roller 41 and the scraping tool 1100 and the wrapping connection mechanism Z, and (*b*) is a schematic view of the same taken from above.

The scraping tool 1100 is constituted of a cutter blade 1003 and a fixing tool 1002 for the cutter blade 1003 and is attached to the wrapping connection mechanism Z.

For example, the wrapping connection mechanism Z is configured by rotatably providing a pair of pulleys 1000*a* and 1000*b* in the vicinity of left and right ends of the platen roller 41 and stretching an endless belt 1001 between the pulleys 1000*a* and 1000*b*.

The fixing toll 1002 is secured to the endless belt 1001 and adjusted such that the edge of the cutter blade 1003 is in a position where it slides in contact with a circumferential surface of the platen roller 41.

A driving source that is not shown is connected to either of the pulleys 1000*a* and 1000*b* to switch the rotation of the same between forward rotation and reverse rotation at predetermined timing. Therefore, the scraping tool 1100 secured to the endless belt 1001 is moved back and forth in the axial direction of the platen roller 41 when the pulleys 1000*a* and 1000*b* are started.

Reference numeral 1004 shown in FIG. 8(*b*) represents a driven roller for preventing the endless belt 1001 from slacking. Thus, when the platen roller 41 and the wrapping connection mechanism Z are started, the edge of the cutter blade 1003 of the scraping tool 1100 can scrape and remove the heat sensitive adhesive G1 and the product G2 of denaturation of the heat sensitive adhesive that have adhered to the circumferential surface of the platen roller 41 while moving horizontally in the axial direction of the platen roller 41.

Figure 9:
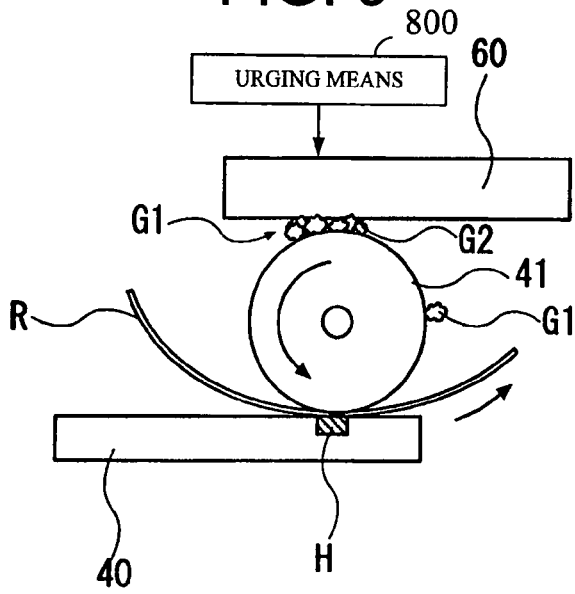
FIG. 9 is a schematic configuration diagram showing another example of means for removing a heat sensitive adhesive and the like in the thermal activation unit.

FIG. 9 shows an embodiment in which a transfer material 60 is provided in place of the scraper 50.

The transfer material 60 slides in contact with a circumferential surface of the platen roller 41 for thermal activation, and the heat sensitive adhesive G1 and the product G2 of denaturation of the heat sensitive adhesive that have adhered to the platen roller 41 for thermal activation are transferred to the same.

The transfer material 60 may be constituted of any of rubber, resin, paper, synthetic paper, and cloth. As shown in FIG. 9, the transfer material is urged into non-rotatable contact with the surface of the platen roller 41 for thermal activation by urging means 800. Further, the transfer material 60 may be moved to prevent the heat sensitive adhesive G1 and the product G2 of denaturation of the heat sensitive adhesive from adhering to the same region. The transfer material 60 is desirably periodically cleaned or replaced in order to prevent the heat sensitive adhesive G1 and the product G2 of denaturation of the heat sensitive adhesive transferred to the transfer material 60 from again adhering to the platen roller 41 for thermal activation.

Figure 10:
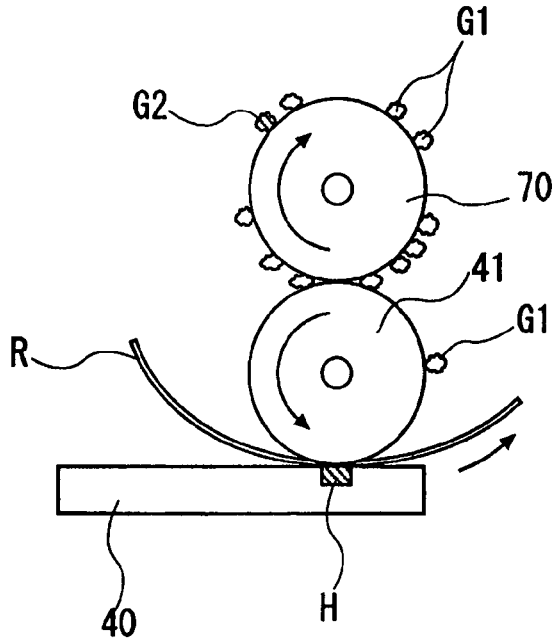
FIG. 10 is a schematic configuration diagram showing another example of means for removing a heat sensitive adhesive and the like in the thermal activation unit.

FIG. 10 shows an example in which a cleaning roll 70 is provided in place of the scraper 50. The cleaning roll 70 is provided in parallel with the platen roller 41 for thermal activation (above the same in the example in FIG. 10) and is pivotally supported such that a circumferential surface thereof contacts a circumferential surface of the platen roller 41 for thermal activation to be driven by the same for rotation. The cleaning roll 70 may be constituted of any of natural rubber, synthetic natural rubber, urethane rubber, silicon rubber, and fluoro rubber or any of phenol resin, epoxy resin, polyester resin, silicon resin, acryl resin, vinyl chloride, and polyethylene resin.

The heat sensitive adhesive G1 and the product G2 of denaturation of the heat sensitive adhesive that have adhered to the platen roller 41 for thermal activation are removed by being transferred to the circumferential surface of the cleaning roll 70 at the point of contact between the cleaning roll 70 and the same. The circumferential surface of the cleaning roll 70 is desirably periodically cleaned in order to prevent the heat sensitive adhesive G1 and the product G2 of denaturation of the heat sensitive adhesive transferred to the circumferential surface of the cleaning roll 70 from adhering to the platen roller 41 for thermal activation again.

Figure 11:
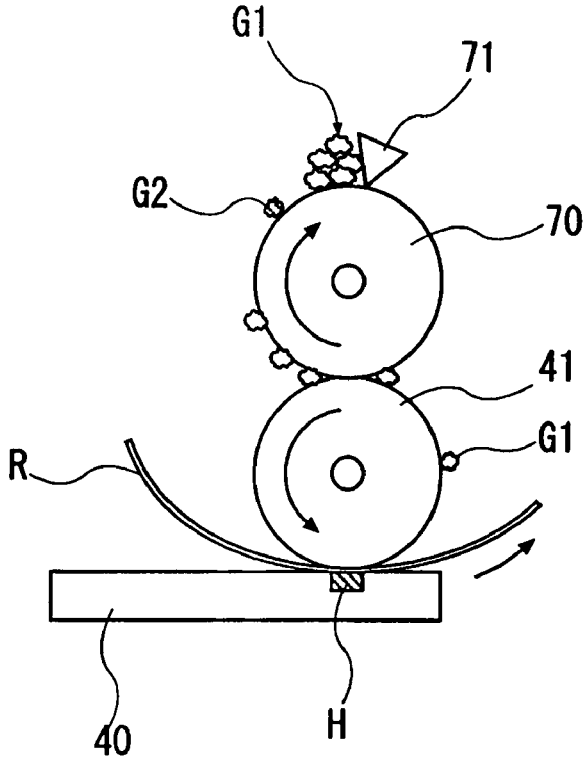
FIG. 11 is a schematic configuration diagram showing another example of means for removing a heat sensitive adhesive and the like in the thermal activation unit.

FIG. 11 shows an example in which a knife-shaped member (scraper) 71 is provided such that it slides in contact with a circumferential surface of the cleaning roll 70. For example, the scraper 71 is constituted of rubber, plastic, metal or rubber, plastic, or metal whose surface is fluororesin-processed and is formed with a width slightly greater than a lateral width of the cleaning roll 70. The scraper 71 is urged by urging means that is not shown into contact with a surface of the cleaning roll 70. This makes it possible to remove the heat sensitive adhesive G1 and the product G2 of denaturation of the heat sensitive adhesive that have been adsorbed to the surface of the cleaning roll 70 by scraping them with the scraper 71, and the platen roller 41 for thermal activation can be more reliably cleaned. The scraper 71 is desirably periodically cleaned in order to prevent the heat sensitive adhesive G1 and the product G2 of denaturation of the heat sensitive adhesive that have adhered to the scraper 71 from adhering to the cleaning roll 70 and the platen roller 41 for thermal activation again.

Figure 12:
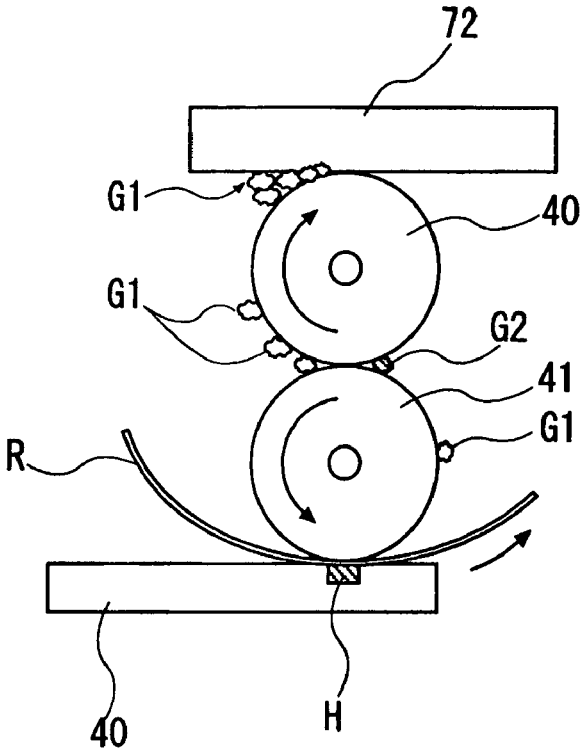
FIG. 12 is a schematic configuration diagram showing another example of means for removing a heat sensitive adhesive and the like in the thermal activation unit.

FIG. 12 shows an example in which a transfer material 72 is provided such that it slides in contact with a circumferential surface of the cleaning roll 70. The transfer material 72 may be constituted of any of rubber, resin, paper, synthetic paper, and cloth. The transfer material 72 is urged into contact with a surface of the platen roller 41 for thermal activation by urging means that is not shown. This makes it possible to remove the heat sensitive adhesive G1 and the product G2 of denaturation of the heat sensitive adhesive that have been adsorbed to the surface of the cleaning roll 70 by transferring them to the transfer material 72, and the cleaning roll 70 and the platen roller 41 for thermal activation can be more reliably cleaned. The transfer material 72 is desirably periodically cleaned or replaced in order to prevent the heat sensitive adhesive G1 and the product G2 of denaturation of the heat sensitive adhesive transferred to the transfer material 72 from adhering to the cleaning roll 70 and the platen roller 41 for thermal activation again.

A description will now be made with reference to FIG. 13 to FIG. 16 on an example in which the platen roller 41 for thermal activation is provided with anti-adhesion means for preventing the heat sensitive adhesive G1 and the product G2 of denaturation of the heat sensitive-adhesive from adhering thereto.

While the above-described FIG. 2 to FIG. 12 have showed an example in which the heat sensitive adhesive G1 and the product G2 of denaturation of the heat sensitive adhesive that have adhered to the platen roller 41 for thermal activation are removed afterward, the anti-adhesion means is means for preventing the heat sensitive adhesive G1 and the product G2 of denaturation of the heat sensitive adhesive from adhering to the circumferential surface of the platen roller 41 for thermal activation.

Figure 13:
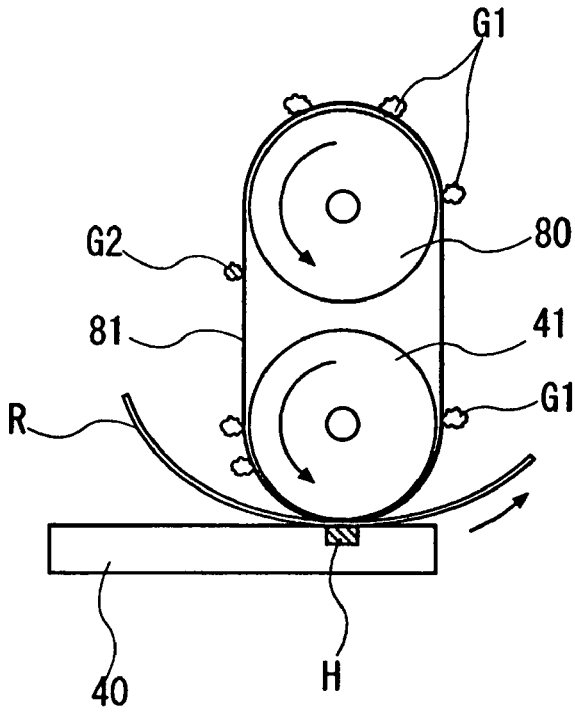
FIG. 13 is a schematic configuration diagram showing an example of anti-adhesion means for a heat sensitive adhesive and the like in the thermal activation unit.

FIG. 13 shows an example of a configuration in which a sheet material 81 for cleaning in the form of an endless belt is stretched and circulated between the platen roller 41 for thermal activation and a driven roller 80 that is provided in parallel with the platen roller 41 for thermal activation (above the same in FIG. 13).

The sheet material 81 for cleaning may be constituted of any of rubber, resin, paper, synthetic paper, and cloth.

Since the platen roller 41 for thermal activation thus urges the thermal head 40 and a heat sensitive adhesive label R through the sheet material 81 for cleaning, it is possible to prevent the surface of the platen roller 41 for thermal activation from directly contacting the thermal head 40 (heating element H) even during idle running of the platen roller 41 for thermal activation (in a state in which no heat sensitive adhesive label R has reached the same). This makes it possible to prevent the heat sensitive adhesive G1 and the product G2 of denaturation of the heat sensitive adhesive that have adhered to the thermal head 40 and the like from adhering to the platen roller 41 for thermal activation. The heat sensitive adhesive G1 and the product G2 of denaturation of the heat sensitive adhesive that have adhered to the thermal head 40 are removed by being adsorbed to a surface of the sheet material 81 for cleaning in the state in which no heat sensitive adhesive label R has arrived.

The running cost of the sheet material 81 for cleaning can be reduced through a reduction of the frequency of replacement of the same by circulating and reusing the sheet material 81 for cleaning in the form of an endless belt.

Figure 14:
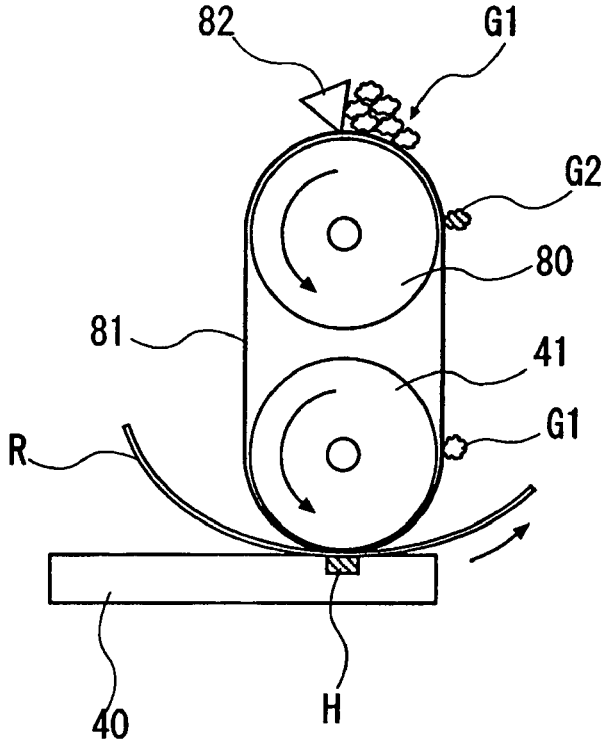
FIG. 14 is a schematic configuration diagram showing another example of anti-adhesion means for a heat sensitive adhesive and the like in the thermal activation unit.

FIG. 14 shows an example in which a knife-shaped member 82 is provided such that it slides in contact with the sheet material 81 for cleaning. For example, the knife-shaped member 82 is constituted of rubber, plastic, metal or rubber, plastic, or metal whose surface is fluororesin-processed and is formed with a width slightly greater than a lateral width of the sheet material 81 for cleaning. The knife-shaped member 82 is urged by urging means that is not shown into contact with a surface of the sheet material 81 for cleaning. This makes it possible to remove the heat sensitive adhesive G1 and the product G2 of denaturation of the heat sensitive adhesive adsorbed to the surface of the sheet material 81 for cleaning by scraping them with the knife-shaped member 82 and to thereby prevent them from smearing and damaging the printing surface of the heat sensitive adhesive label R with reliability. The knife-shaped member 82 is desirably periodically cleaned or replaced in order to prevent the heat sensitive adhesive G1 and the product G2 of denaturation of the heat sensitive adhesive that have adhered to the knife-shaped member 82 from adhering to the surface of the sheet material 81 for cleaning again.

Figure 15:
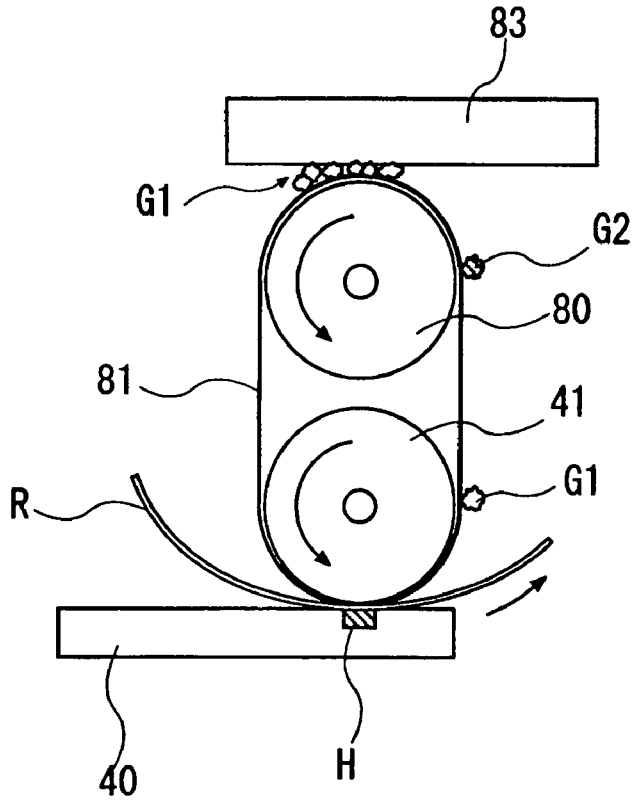
FIG. 15 is a schematic configuration diagram showing another example of anti-adhesion means for a heat sensitive adhesive and the like in the thermal activation unit.

FIG. 15 shows an example in which a transfer material 83 is provided in place of the knife-shaped member 82 such that it slides in contact with the sheet material 81 for cleaning. The transfer material 83 may be constituted of any of rubber, resin, paper, synthetic paper, and cloth. The transfer material 83 is urged into contact with the surface of the platen roller 41 for thermal activation by urging means that is not shown.

This makes it possible to remove the heat sensitive adhesive G1 and the product G2 of denaturation of the heat sensitive adhesive adsorbed to the surface of the sheet material 81 for cleaning by transferring them to the transfer material 83 and to thereby prevent them from smearing and damaging the printing surface of the heat sensitive adhesive label R with reliability. The transfer material 83 is desirably periodically cleaned or replaced in order to prevent the heat sensitive adhesive G1 and the product G2 of denaturation of the heat sensitive adhesive that have transferred to the transfer material 83 from adhering to the sheet material 81 for cleaning again.

Figure 16:
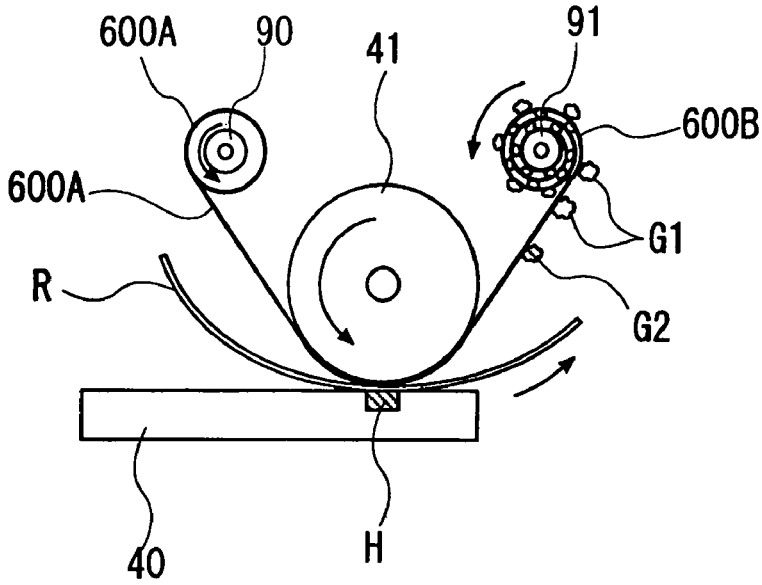
FIG. 16 is a schematic configuration diagram showing another example of anti-adhesion means for a heat sensitive adhesive and the like in the thermal activation unit.
Figure 17:
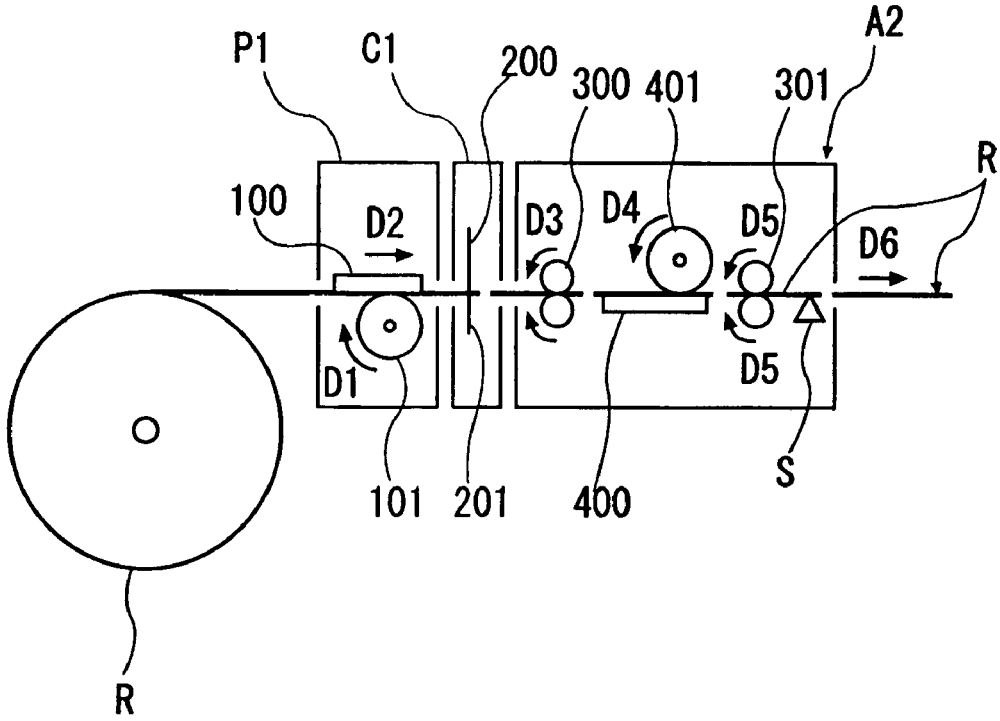
FIG. 17 PRIOR ART
FIG. 17 is a schematic diagram showing a configuration of a conventional thermal printer.

FIG. 16 shows an example in which a disposable sheet material 600 for cleaning is used as the anti-adhesion means. The sheet material 600 for cleaning is wound a round a feed roller 90 and a take-up roller 91 that are provided in parallel with each other before and after the platen roller 41 for thermal activation and that are rotatably disposed, and it is sequentially paid out as a result of rotation of the platen roller 41 for thermal activation.

Specifically, an elongate unused sheet material 600A for cleaning wound around the feed roller 90 is sequentially pulled out into the gap between the platen roller 41 for thermal activation an the thermal head 40 and is sequentially wound and collected by the take-up roller 91 as a used sheet material 600B for cleaning after cleaning the surface of the thermal head 40. Therefore, the heat sensitive adhesive G1 and the product G2 of denaturation of the heat sensitive adhesive adsorbed by the sheet material 600A for cleaning from the surface of the thermal head 40 are sequentially wound and collected by the take-up roller 91 along with the used sheet material 600B for cleaning, as shown in FIG. 16. This eliminates the need for the means for removing the heat sensitive adhesive G1 and the product G2 of denaturation of the heat sensitive adhesive that have adhered to the sheet material 600 for cleaning and the need for the operation of cleaning it. Further, since a clean surface of the sheet material 600A for cleaning always contacts the heat sensitive adhesive sheet R, smearing and damage on the printing surface of the heat sensitive adhesive sheet R can be reliably avoided.

While the invention made by the present inventor has been specifically described based on embodiments of the same, the present invention is not limited to the above-described embodiments and may be modified in various ways within the scope of the teaching thereof.

For example, the sheet material 600 for cleaning shown in FIG. 16 may be contained in a cassette-type case to improve ease of handling.

The surfaces of the cleaning roll 70, the sheet materials 81 and 600 for cleaning may be processed to provide them with an adhesive property, thereby improving the performance of removing the heat sensitive adhesive G1 and the product G2 of denaturation of the heat sensitive adhesive.

A triangular configuration, a configuration like a cutter blade, a circular configuration, and the like may be used as the sectional configuration of the scrapers 50, 71, and 82.

A configuration may be employed in which the transfer material 60, 72 or 83 is formed like a sheet, sequentially paid out like the sheet material 600 for cleaning shown in FIG. 16, and wound and collected after the heat sensitive adhesive G1 and the product G2 of denaturation of the heat sensitive adhesive are transferred to the same. This eliminates the need for the means for removing the heat sensitive adhesive G1 and the product G2 of denaturation of the heat sensitive adhesive transferred to the sheet-like transfer material and the need for the operation of cleaning it. Further, since a clean surface of the transfer material always contacts the heat sensitive adhesive sheet R, smearing and damage on the printing surface of the same can be reliably avoided.

Further, the sheet materials 81 and 600 for cleaning may be impregnated with a solvent or the like into which the heat sensitive adhesive G1 and the product G2 of denaturation of the heat sensitive adhesive can be dissolved to improve the performance of removing the heat sensitive adhesive G1 and the product G2 of denaturation of the heat sensitive adhesive.

While the present mode for carrying out the invention has been described with reference to cases in which a heat sensitive printer unit is used, this is not limiting the invention, and inkjet types, laser print types, and the like may be used. In such cases, a surface treatment is carried out on the printable surface of a heat sensitive adhesive sheet in accordance with each printing type of printing instead of the thermal coat layer.

As described above, a thermal activator for a heat sensitive adhesive sheet according to the present invention is a thermal activator for a heat sensitive adhesive sheet having at least heating means for activation for heating and activating a heat sensitive adhesive layer of a heat sensitive adhesive sheet constituted of a printable surface and the heat sensitive adhesive layer formed on one and another side of a label base material respectively and transport means for transporting the heat sensitive adhesive sheet in a predetermined direction, and there is provided anti-adhesion means for preventing the heat sensitive adhesive or a product of denaturation of the heat sensitive adhesive from adhering to the transport means or removal means for removing the heat sensitive adhesive and the product of denaturation of the heat sensitive adhesive that have adhered to the transport means. This is advantageous in that the heat sensitive adhesive is prevented from adhering to the transport means and in that the heat sensitive adhesive that has adhered to the transport means can be removed. This results in an advantage in that smearing and damage on the printable surface and insufficient thermal activation can be avoided when the heat sensitive adhesive sheet is thermally activated by the thermal activator.

What is claimed is:

1. A thermal activator for a heat sensitive adhesive sheet, the thermal activator comprising:

heating means for heating a heat sensitive adhesive layer of a heat sensitive adhesive sheet to activate the adhesive layer, the adhesive sheet having a printable surface formed on one side of a sheet-like base and the heat sensitive adhesive layer formed on the other side thereof;

a platen roller mounted to undergo rotation to transport the heat sensitive adhesive sheet in a predetermined direction; and anti-adhesion means for preventing a heat sensitive adhesive of the heat sensitive adhesive layer and a denatured product of the heat sensitive adhesive from adhering to the platen roller, the anti-adhesion means comprising a sheet material interposed between the platen roller and the printable surface of the heat sensitive adhesive sheet.

2. A thermal activator for a heat sensitive adhesive sheet according to claim 1; further comprising feeding means for feeding the sheet material in the same direction as the direction in which the heat sensitive adhesive sheet is transported during rotation of the platen roller.

3. A thermal activator for a heat sensitive adhesive sheet according to claim 1; wherein the heating means comprises a thermal head; and wherein the sheet material is wider than a lateral width of the thermal head.

4. A thermal activator for a heat sensitive adhesive sheet according to claim 1; further comprising a feed roller and a take up roller rotatably mounted in parallel relation to one another on opposite sides of the platen roller; and wherein the sheet material is wound around the feed roller and the take up roller and is sequentially fed by the feeding means during rotation of the platen roller.

5. A thermal activator for a heat sensitive adhesive sheet according to claim 1; wherein the sheet material is in the form of an endless belt disposed in parallel relation with the platen roller; and further comprising a roller for circulating the endless belt between the platen roller and the printable surface of the heat sensitive adhesive sheet.

6. A thermal activator for a heat sensitive adhesive sheet according to claim 5; wherein the anti-adhesion means further comprises a knife-shaped member disposed in slidable contact with a surface of the sheet material to scrape the heat sensitive adhesive and the denatured product of the heat sensitive adhesive that have adhered to the surface of the sheet material.

7. A thermal activator for a heat sensitive adhesive sheet according to claim 5; wherein the anti-adhesion means further comprises a transfer material disposed in slidable contact with a surface of the sheet material to transfer the heat sensitive adhesive and the denatured product of the heat sensitive adhesive that have adhered to the surface of the sheet material to the transfer material.

8. A thermal activator for a heat sensitive adhesive sheet according to claim 1; wherein the sheet material is made from a material selected from the group consisting of rubber, resin, paper, synthetic paper, and cloth.

9. A thermal activator for a heat sensitive adhesive sheet, the thermal activator comprising:

heating means for heating a heat sensitive adhesive layer of a heat sensitive adhesive sheet to activate the adhesive layer, the adhesive sheet having a printable surface formed on one side of a sheet-like base and the heat sensitive adhesive layer formed on the other side thereof;

transport means from transporting the heat sensitive adhesive sheet in a predetermined direction; and anti-adhesion means for preventing a heat sensitive adhesive of the heat sensitive adhesive layer and a denatured product of the heat sensitive adhesive from adhering to the transport means, the anti-adhesion means comprising a sheet material impregnated with a solvent for dissolving the heat sensitive adhesive and the denatured product of the heat sensitive adhesive.

10. A thermal activator for a heat sensitive adhesive sheet, the thermal activator comprising:

a heating device that heats a heat sensitive adhesive layer of a heat sensitive adhesive sheet to activate the adhesive layer, the adhesive sheet having a printable surface formed on one side of a sheet-like base and the heat sensitive adhesive layer formed on the other side thereof;

a platen roller mounted to undergo rotation to transport the heat sensitive adhesive sheet in a predetermined direction; and a sheet material that is interposed between the platen roller and the printable surface of the heat sensitive adhesive sheet and that prevents a heat sensitive adhesive of the heat sensitive adhesive layer and a denatured product of the heat sensitive adhesive from adhering to the platen roller.

11. A thermal activator for a heat sensitive adhesive sheet according to claim 10; further comprising a feeding device that feeds the sheet material in the same direction as the direction in which the heat sensitive adhesive sheet is transported during rotation of the platen roller.

12. A thermal activator for a heat sensitive adhesive sheet according to claim 11; further comprising a feed roller and a take-up roller rotatably mounted in parallel relation to one another on opposite sides of the platen roller; and wherein the sheet material is wound around the feed roller and the take-up roller and is sequentially fed by the feeding device during rotation of the platen roller.

13. A thermal activator for a heat sensitive adhesive sheet according to claim 10; wherein the sheet material is in the form of an endless belt disposed in parallel relation with the platen roller; and further comprising a roller for circulating the endless belt between the platen roller and the printable surface of the heat sensitive adhesive sheet.

14. A thermal activator for a heat sensitive adhesive sheet according to claim 10; further comprising a knife-shaped member disposed in slidable contact with a surface of the sheet material to scrape the heat sensitive adhesive and the denatured product of the heat sensitive adhesive that have adhered to the surface of the sheet material.

15. A thermal activator for a heat sensitive adhesive sheet according to claim 10; further comprising a transfer material disposed in contact with a surface of the sheet material to transfer the heat sensitive adhesive and the denatured product of the heat sensitive adhesive that have adhered to the surface of the sheet material to the transfer material.

16. A thermal activator for a heat sensitive adhesive sheet according to claim 10; wherein the sheet material is made from a material selected from the group consisting of rubber, resin, paper, synthetic paper, and cloth.

17. A thermal activator for a heat sensitive adhesive sheet according to claim 10; wherein the sheet material is impregnated with a solvent for dissolving the heat sensitive adhesive and the denatured product of the heat sensitive adhesive.

18. A thermal activator for a heat sensitive adhesive sheet, the thermal activator comprising:

a thermal head that heats a heat sensitive adhesive layer of a heat sensitive adhesive sheet to activate the adhesive layer, the adhesive sheet having a printable surface formed on one side of a sheet-like base and the heat sensitive adhesive layer formed on the other side thereof;

a transporting device that transports the heat sensitive adhesive sheet in a predetermined direction; and a sheet material that prevents a heat sensitive adhesive of the heat sensitive adhesive layer and a denatured product of the heat sensitive adhesive from adhering to the transporting device, the sheet material being wider than a lateral width of the thermal head.

* * * * *